US007264919B2

(12) United States Patent
Yamane et al.

(10) Patent No.: US 7,264,919 B2
(45) Date of Patent: Sep. 4, 2007

(54) MONO-SHEET HEAT-DEVELOPABLE PHOTOSENSITIVE MATERIAL AND METHOD OF FORMING IMAGE

(75) Inventors: Katsutoshi Yamane, Kanagawa (JP); Masatoshi Nakanishi, Kanagawa (JP); Fumito Nariyuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/422,803

(22) Filed: Apr. 25, 2003

(65) Prior Publication Data

US 2003/0211428 A1 Nov. 13, 2003

(30) Foreign Application Priority Data

Apr. 26, 2002 (JP) ..... P.2002-126384

(51) Int. Cl.
*G03C 5/16* (2006.01)
*G03C 1/498* (2006.01)

(52) U.S. Cl. ..... 430/350; 430/620; 430/619; 430/945

(58) Field of Classification Search ..... 430/350, 430/619, 620, 945
See application file for complete search history.

(56) References Cited

U.S. PATENT DOCUMENTS

| | | | | |
|---|---|---|---|---|
| 5,952,167 | A * | 9/1999 | Okada et al. | 430/619 |
| 5,998,126 | A * | 12/1999 | Toya et al. | 430/619 |
| 6,143,488 | A | 11/2000 | Uytterhoeven et al. | |
| 6,335,153 | B1 * | 1/2002 | Toya | 430/350 |
| 6,344,313 | B1 * | 2/2002 | Goto et al. | 430/619 |
| 2001/0029000 | A1 * | 10/2001 | Yoshioka et al. | 430/607 |
| 2003/0091347 | A1 * | 5/2003 | Goto et al. | 396/564 |
| 2003/0118953 | A1 | 6/2003 | Yamane et al. | |

* cited by examiner

*Primary Examiner*—Thorl Chea
(74) *Attorney, Agent, or Firm*—Sughrue Mion, PLLC

(57) ABSTRACT

A mono-sheet heat-developable photosensitive material, which comprises a layer containing a light-sensitive silver halide, a light-insensitive organic fatty acid silver salt, a thermal developer and a binder on a support, and exhibits substantially no sensitivity after being subjected to heat-development.

2 Claims, 4 Drawing Sheets

MONO-SHEET HEAT-DEVELOPABLE PHOTOSENSITIVE MATERIAL AND METHOD OF FORMING IMAGE

FIELD OF THE INVENTION

The present invention relates to a heat-developable photosensitive material and a method of forming an image using the same.

BACKGROUND OF THE INVENTION

In the medical field, reduction in wastes of processing solutions has been strongly desired from the viewpoints of environmental conservation and space saving in recent years. Therefore, new technologies regarding light-sensitive heat-developable photographic materials used for medical diagnosis and photographic technology, which can be efficiently exposed by means of a laser image setter or a laser imager and form clear black images having high resolution and high sharpness, have been requested. It is possible for such light-sensitive heat-developable photographic materials to eliminate the necessity of using solutions of processing chemicals and to supply simpler and environmentally friendly heat-developable processing systems for customers.

Though such requirements are also present in the field of common image-forming materials, images for medical use are required to have high qualities including excellent sharpness and graininess, because fine depiction is essential to them. Also, they have a feature that it is desirable to have a cold black tone from a viewpoint of ease of diagnosis. At present, various kinds of hard copy systems utilizing pigment or dye, for example, inkjet printers and electrophotography, are distributed as common image-forming systems, but they are not satisfactory as output system of images for medical use.

On the other hand, thermal image formation systems utilizing organic fatty acid silver salts are described, e.g., in U.S. Pat. Nos. 3,152,904 and 3,457,075, and B. Shely, Thermally Processed Silver Systems in *Imaging Processes and Materials*, Neblette's 8th Edition, compiled by Sturge, V. Walworth and A, Shepp, page 2 (1996).

In particular, a heat-developable photosensitive material ordinarily has a light-sensitive layer containing a binder matrix dispersed therein a catalytic amount of photocatalyst (e.g., silver halide), a reducing agent, a reducible silver salt (e.g., an organic fatty acid silver salt) and, if desired, a toning agent for controlling color tone of silver. After imagewise exposure, the heat-developable photosensitive material is heated at a high temperature (e.g., 80° C. or higher) to cause a redox reaction between the silver halide or reducible silver salt (acting as an oxidizing agent) and the reducing agent, thereby forming a black silver image. The redox reaction is accelerated by the catalytic action of a latent image of the silver halide formed upon the image exposure. Thus, the black silver image is formed in the exposed area. The heat-developable photosensitive materials are described in many documents including U.S. Pat. No. 2,910,377 and JP-B-43-4924 (the term "JP-B" as used herein means an "examined Japanese patent publication"). Also, Fuji Medical Dry Imager FM-DP L is available as a medical image formation system utilizing a heat-developable photosensitive material.

In the thermal image formation system utilizing an organic fatty acid silver salt, a heat-developable photosensitive material is produced by a method of using an organic solvent for coating, or a method of applying and drying a coating solution containing an aqueous dispersion of polymer fine particles as a main binder. Since the latter method does not include a step of recovering the solvent, it permits simplification of production facilities and is advantageous for mass production.

The mono-sheet heat-development image formation system utilizing an organic fatty acid silver salt does not include a fixing step. Accordingly, the system has a serious problem with image preservability after the development processing, particularly deterioration of print-out due to exposure to light.

Moreover, there is a large restriction in design of heat-developing machine because the heat-developable photosensitive material is prohibited from exposure to light until the heat-developed material has been completely cooled. Therefore, development of heat-developable photosensitive material capable of designing a simple and small-size heat-developing machine has been desired.

In JP-A-8-76317 (the term "JP-A" as used herein means an "unexamined published Japanese patent application") and JP-A-8-304952, methods of adding a large amount of mercapto compound in order to fix silver halide are described. However, such methods are disadvantageous since the large amount of additive is necessary.

SUMMARY OF THE INVENTION

Therefore, an object of the invention is to provide a mono-sheet heat-developable photosensitive material that has high sensitivity and excellent handlability after development and is capable of designing a simple and small-size heat-developing machine.

Another object of the invention is to provide a method of forming an image using such a photosensitive material.

Other objects of the invention will become apparent from the following description.

The objects of the invention can be accomplished by using a heat-developable photosensitive material as described below.

(1) A mono-sheet heat-developable photosensitive material, which comprises a layer containing a light-sensitive silver halide, a light-insensitive organic fatty acid silver salt, a thermal developer and a binder on a support, and exhibits substantially no sensitivity after being subjected to heat-development.

The invention also includes the following items.

(2) The mono-sheet heat-developable photosensitive material as described in item (1) above, wherein the light-insensitive organic fatty acid silver salt has a specific space area of not less than 10.

(3) The mono-sheet heat-developable photosensitive material as described in item (1) above, wherein the light-insensitive organic fatty acid silver salt has a specific space area of not less than 15.

(4) The mono-sheet heat-developable photosensitive material as described in any one of items (1) to (3) above, wherein the light-sensitive silver halide has an average silver iodide content of from 5 to 100 mole %.

(5) The mono-sheet heat-developable photosensitive material as described in any one of items (1) to (4) above, wherein the light-sensitive silver halide has been eliminated by dissolution after heat-development.

(6) A method of forming an image comprising heat-developing the mono-sheet heat-developable photosensitive material as described in any one of items (1) to (5) above at a temperature of from 110 to 150° C.

(7) The method of forming an image as described in item (6) above, wherein the mono-sheet heat-developable photosensitive material is exposed using a laser diode light source at light intensity of not less than 1 $mW/mm^2$ on the image-forming surface.

(8) The method of forming an image as described in item (7) above, wherein a wavelength of the laser diode light source is from 350 to 430 nm.

(9) A method of forming an image comprising heat-developing the mono-sheet heat-developable photosensitive material as described in any one of items (1) to (5) above by a heat-developing machine having an exposure section, a heat-development section and a cooling section, wherein a ratio of a zone length of the cooling section to a zone length of the heat-development section is not more than 3.5.

DETAILED DESCRIPTION OF THE INVENTION

The invention will be described in more detail below.

The term "photosensitive material exhibits substantially no sensitivity after being subjected to heat-development" is defined in the following manner.

a) An unexposed photosensitive material is subjected to light exposure, heat-development and optical density measurement. A reciprocal of an exposure amount necessary for obtaining the optical density of 1.0 is defined as Sensitivity A.

b) An unexposed photosensitive material is subjected to the development processing in the same manner as above, then subjected to the light exposure, development processing and optical density measurement in the same manner as above. A reciprocal of an exposure amount necessary for obtaining the optical density of 1.0 is defined as Sensitivity B.

c) When the photosensitive material satisfies the formula of Sensitivity B/Sensitivity A<0.2, it is defined that the photosensitive material exhibits substantially no sensitivity after being subjected to heat-development.

The photosensitive material preferably satisfies the formula of Sensitivity B/Sensitivity A<0.1, and more preferably satisfies the formula of Sensitivity B/Sensitivity A<0.05. The light exposure in the above procedure is conducted in a range of an inherent absorption wavelength of silver halide, that is, from 350 to 420 nm.

Figure 2:
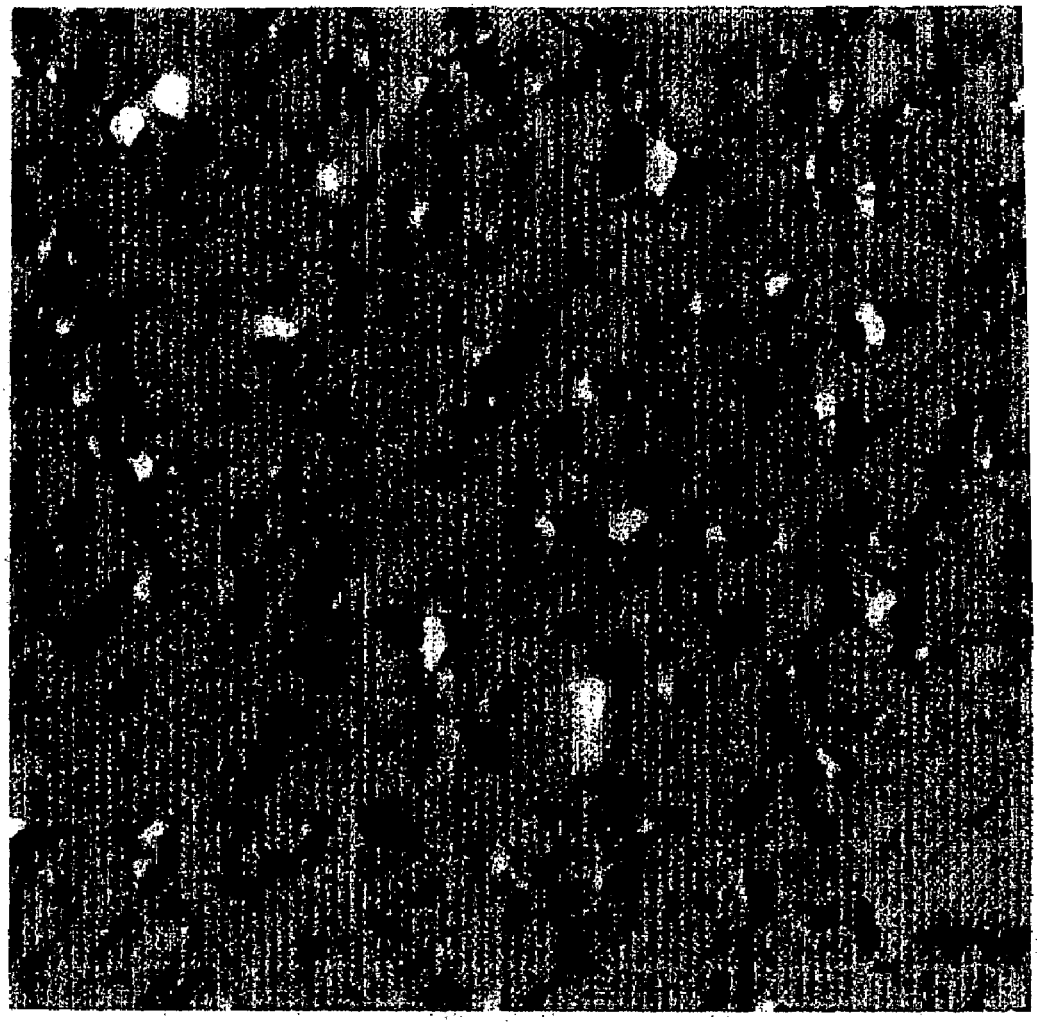
FIG. 2 is a photograph indicating a cross-section of the photosensitive material of the invention before heat-development.
Figure 3:
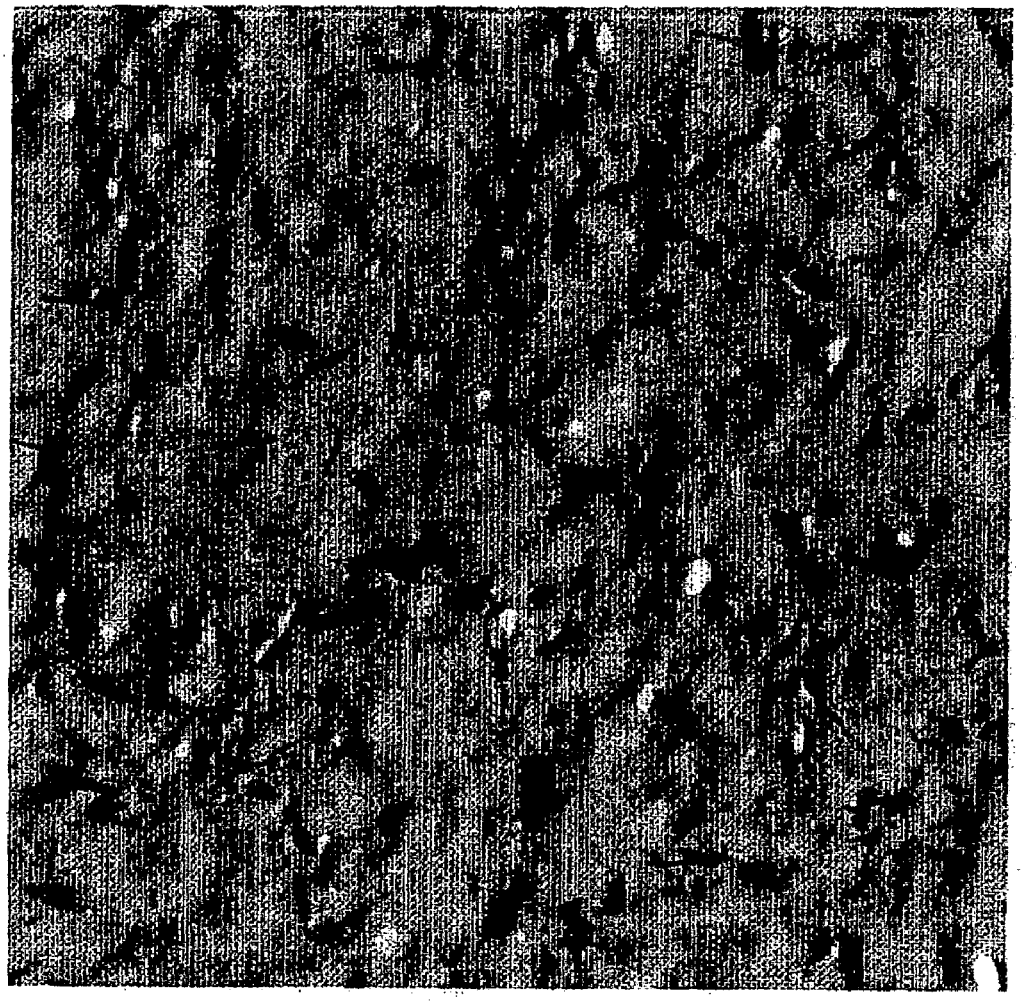
FIG. 3 is a photograph indicating a cross-section of the photosensitive material of the invention after heat-development.

The photosensitive material exhibits substantially no sensitivity after being subjected to heat-development can be realized by disappearance of silver halide by means of the heat-development. A photograph indicating a cross-section of the photosensitive material of the invention before the heat-development is shown in FIG. 2, and a photograph indicating a cross-section of the photosensitive material of the invention after the heat-development is shown in FIG. 3. While both fatty acid silver salt grains and silver halide grains (fine black spots) are observed in the photograph of FIG. 2, it can be seen that the silver halide grains (fine black spots) have disappeared by means of the heat-development in the photograph of FIG. 3. By realizing such conditions, the photosensitive material exhibits substantially no sensitivity after being subjected to heat-development can be provided.

It has been found that silver iodide is effectively used as described below in order to realize fixation of silver halide in the system using a mono-sheet heat-developable photosensitive material according to the invention, which dose not generate waste materials resulting from development and is free from a desalting step, for example, fixing.

Now, light-sensitive silver halide preferably used in the invention will be described in detail below. Regarding a halogen composition of the light-sensitive silver halide, a high silver iodide content emulsion containing from 5 to 100 mole % of silver iodide is preferred. It is known that the high silver iodide content emulsion has ordinarily low sensitivity and a low utility value. On the contrary, as a result of the investigations, it has been found that high sensitivity and high sharpness can be achieved by incorporating the silver halide of high silver iodide content into a heat-developable photosensitive material containing a light-insensitive organic fatty acid silver salt and a thermal developer and exposing the heat-developable photosensitive material at high light intensity of not less than 1 $mW/mm^2$ for a short period of time (not more than 1 second, preferably not more than $10^{-2}$ second, and more preferably not more than $10^{-4}$ second).

When the silver halide of high silver iodide content is used, the silver halide disappears after the heat-development and preferably results in severe reduction of sensitivity. A grain size of the silver halide used is preferably not more than 80 nm. When the grain size of the silver halide is too large, the silver halide does not disappear by means of the heat-development processing and remains in the photosensitive material after the processing. The grain size of the silver halide is more preferably from 5 to 70 nm, and still more preferably from 10 to 50 nm. Using the silver halide having such a fine grain size, the effects of the invention are distinctly achieved. The term "grain size" used herein means a diameter of a circle image having an area equivalent to the projected area of silver halide grain, and in case of a tabular grain, the projected area is that of the main plane.

An average silver iodide content of the light-sensitive silver halide is preferably from 5 to 100 mole %. The average silver iodide content is more preferably from 10 to 100 mole %, still more preferably from 40 to 100 mole %, still further more preferably from 70 to 100 mole %, and particularly preferably from 90 to 100 mole %. As the average silver iodide content increases, the effects of the invention are more distinctly achieved.

It is preferable that the light-sensitive silver halide for use in the invention has the direct transition light absorption originated from the silver iodide crystal structure in a wavelength range of from 350 to 450 nm. Whether the light-sensitive silver halide has the light absorption based on the direct transition or not can be easily recognized by the observation of exciton absorption resulting from the direct transition in the vicinity of 400 to 430 nm.

Figure 1:
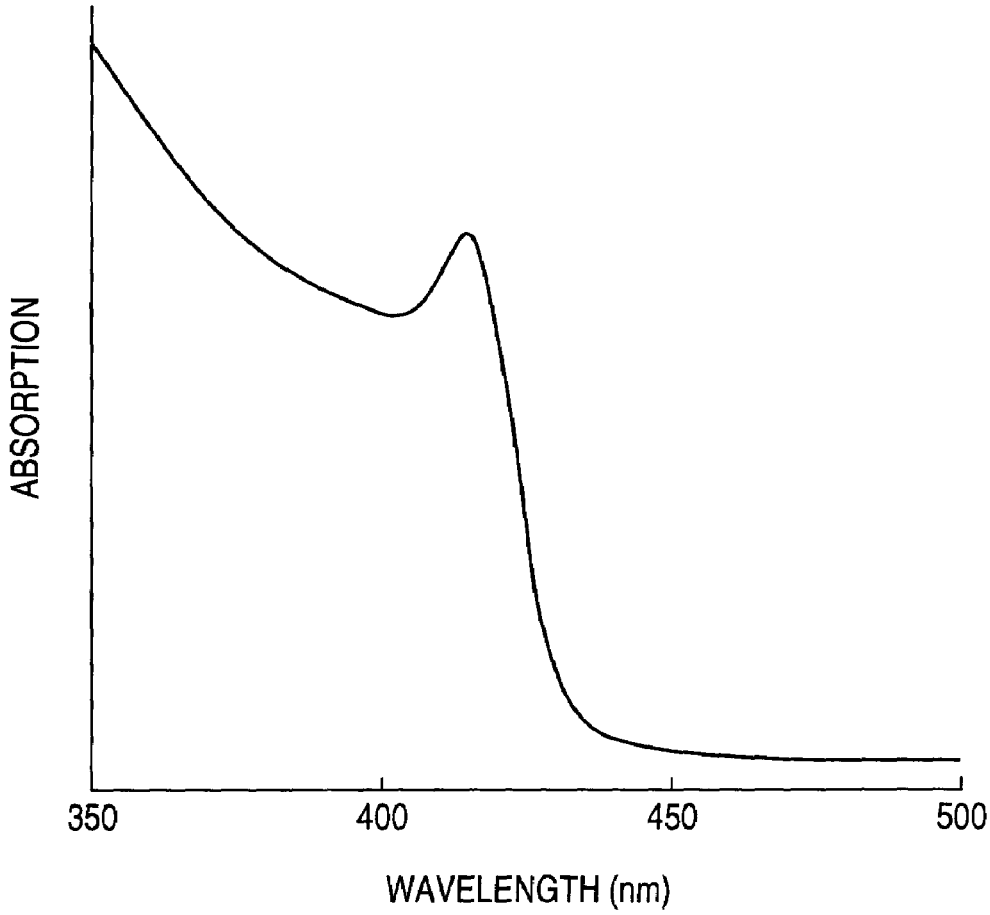
FIG. 1 is a graph showing a light absorption curve of a silver iodide emulsion preferably used in the invention.

A light absorption curve of a silver iodide emulsion preferably used in the invention is shown in FIG. 1. As can be seen from FIG. 1, the absorption resulting from the exciton of silver iodide is observed in the vicinity of 420 nm.

The high silver iodide content phase showing the direct transition light absorption may be present individually. It is also preferred that the phase junctions to silver halide showing indirect transition light absorption in a wavelength region of from 350 to 450 nm, for example, silver bromide, silver chloride, silver iodobromide, silver iodochloride or mixed crystal thereof.

The average silver iodide content in the junction silver halide grains is preferably from 5 to 100 mole %. The average silver iodide content is more preferably from 10 to 100 mole %, still more preferably from 40 to 100 mole %, still further more preferably from 70 to 100 mole %, and particularly preferably from 90 to 100 mole %.

The wavelength of light for exposure is preferably from 370 to 430 nm, more preferably from 390 to 430 nm, and particularly preferably from 390 to 420 nm.

Methods for the formation of light-sensitive silver halide are well known in the field of art. For instance, the methods described in *Research Disclosure*, No. 17029 (June, 1978) and U.S. Pat. No. 3,700,458 can be used. More specifically, the light-sensitive silver halide is prepared by adding a silver-supplying compound and a halogen-supplying compound to a gelatin or other polymer solution, and then mixed with an organic fatty acid silver salt. It is also preferred to use the method described in JP-A-11-119374, paragraphs [0217] to [0224] and the methods described in JP-A-11-352627 and JP-A-2000-347335.

A shape of the silver halide grain includes cubic grain, octahedral grain, dodecahedral grain, tetradecahedral grain, tabular grain, spherical grain, rod-like grain and potato-like grain. In the invention, tetradecahedral grain is particularly preferred. Silver halide grain having rounded corners is also preferably used.

The silver halide grain having a hexacyano metal complex on the outermost surface thereof is preferably used in the invention. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, the hexacyano iron complex is preferably used.

The hexacyano metal complex is present in the form of an ion in the aqueous solution. Therefore, a counter cation thereof is not importance, but it is preferred to use a cation easily miscible with water and suitable for the precipitation operation of silver halide emulsion, for example, an alkali metal ion (e.g., sodiumion, potassium ion, rubidium ion, cesium ion or lithium ion), an ammonium ion or an alkylammonium ion (e.g., tetramethylammonium ion, tetraethylammonium ion, tetrapropylammonium ion or tetra(n-butyl) ammonium ion).

The hexacyano metal complex can be added by dissolving in water or a mixed solvent of water and an appropriate organic solvent miscible with water (e.g., an alcohol, an ether, a glycol, a ketone, an ester or an amide), or mixing with gelatin.

The amount of the hexacyano metal complex added is preferably from $1\times10^{-5}$ to $1\times10^{-2}$ mole, more preferably from $1\times10^{-4}$ to $1\times10^{-3}$ mole, per mole of silver.

In order to form a hexacyano metal complex on the outermost surface of silver halide grain, the hexacyano metal complex is directly added after the completion of addition of an aqueous silver nitrate solution used for the grain formation but before the completion of preparation process of silver halide, specifically, before a chemical sensitization process, in which chalcogen sensitization, for example, sulfur sensitization, selenium sensitization or tellurium sensitization, or noble metal sensitization, for example, gold sensitization is carried out, or during a washing process, a dispersion process or the chemical sensitization process. For the purpose of preventing the growth of fine silver halide grains, it is preferable to add the hexacyano metal complex after the grain formation without delay but before the completion of the preparation process.

The addition of hexacyano metal complex may start after the addition of 96 weight % of the total amount of silver nitrate used for the grain formation, more preferably after the addition of 98 weight % of the total amount of silver nitrate, and particularly preferably after the addition of 99 weight % of the total amount of silver nitrate.

When the hexacyano metal complex is added after the addition of aqueous silver nitrate solution very close to the completion of grain formation as described above, it can adsorb onto the outermost surface of silver halide grain and mostly form a sparingly soluble salt together with silver ion present on the grain surface. The silver salt of hexacyano iron (II) formed is less soluble than AgI, so that redissolution due to fine grain can be prevented, thereby producing silver halide grains having a small grain size.

The light-sensitive silver halide grain for use in the invention can contain metal belonging to Groups VIII to X of the periodic table (indicating the elements of Groups I to XVIII) or a complex thereof.

The metal or the central metal of metal complex belonging to Groups VIII to X of the periodic table includes preferably rhodium, ruthenium and iridium. The metal complexes may be used individually, or as a combination of two or more complexes of the same kind metal or different kinds metals.

The content of metal or metal complex is preferably from $1\times10^{-9}$ to $1\times10^{-3}$ mole per mole of silver.

The metal, metal complex thereof and their addition methods are described in JP-A-7-225449, JP-A-11-65021, paragraphs [0018] to [0024], and JP-A-11-119374, paragraphs [0227] to [0240].

Further, metal complex (e.g., $[Fe(CN)_6]^{-4}$) which can be incorporated into the silver halide grain for use in the invention, and the desalting methods and chemical sensitization methods of silver halide emulsion are described in JP-A-11-84574, paragraphs [0046] to [0050], JP-A-11-65021, paragraphs [0025] to [0031] and JP-A-11-119374, paragraphs [0242] to [0250].

The light-sensitive silver halide emulsion for use in the invention can contain various gelatins. In order that dispersion of the light-sensitive silver halide emulsion in a coating solution containing the organic fatty acid silver salt is maintained in a good condition, it is preferred to use gelatin having a low molecular weight of from 500 to 60,000. Although the low molecular weight gelatin may be used at the time of grain formation process or dispersion process after the desalting process, it is preferred to use at the time of dispersion process after the desalting process.

In the invention, various compounds known as super sensitizers can be used for the purpose of increasing the inherent sensitivity of silver halide. Examples of the super sensitizer for use in the invention include the compounds described, for example, in EP-A-587,338, U.S. Pat. Nos. 3,877,943 and 4,873,184, JP-A-5-341432, JP-A-11-109547 and JP-A-10-111543.

It is preferred that the light-sensitive silver halide grain for use in the invention is chemically sensitized according to a sulfur sensitization method, a selenium sensitization method or a tellurium sensitization method. Compounds preferably used in the sulfur, selenium and tellurium sensitization methods include known compounds, for example, the compounds described in JP-A-7-128768.

In the invention, the tellurium sensitization method is particularly preferably utilized. In the tellurium sensitization method, the compounds described in the references cited in JP-A-11-65021, paragraph [0030], and the compounds represented by formulae (II), (III) and (IV) in JP-A-5-313284 are preferably used.

In the invention, the chemical sensitization can be performed at any time within a period after the completion of grain formation but before coating process. Specifically, it is carried out after the desalting process, (1) before the spectral sensitization, (2) simultaneously with the spectral sensitization, (3) after the spectral sensitization, or (4) immediately before the coating process. It is particularly preferred to perform the chemical sensitization after the spectral sensitization.

The amount of sulfur, selenium and tellurium sensitizers used in the invention may vary depending on, for example, the silver halide grain used and chemical ripening conditions. Specifically, it is in the order of from $10^{-8}$ to $10^{-2}$ mole, preferably from $10^{-7}$ to $10^{-3}$ mole, per mole of silver halide. The conditions for chemical sensitization for use in the invention are not particularly restricted, but ordinarily the pH, pAg and temperature of chemical sensitization are from 5 to 8, from 6 to 11 and from 40 to 95° C., respectively.

To the silver halide emulsion for use in the invention, a thiosulfonic acid compound may be added according to the method described in EP-A-293,917.

In the photosensitive material of the invention, only one light-sensitive silver halide emulsion may be used or two or more light-sensitive silver halide emulsions (for example, those different from each other in the average grain size, halide composition, crystal habit or condition for chemical sensitization) may be used in combination. The use of plural light-sensitive silver halide emulsions different from each other in the sensitivity is useful for control the gradation.

The techniques concerning the combination of silver halide emulsions are described, e.g., in JP-A-57-119341, JP-A-53-106125, JP-A-47-3929, JP-A-48-55730, JP-A-46-5187, JP-A-50-73627 and JP-A-57-150841. As to the sensitivity difference, it is preferred that the sensitivities of silver halide emulsions are different from each other by not less than 0.2 in terms of log E.

The amount of light-sensitive silver halide added is preferably from 0.03 to 0.6 g/m$^2$, more preferably from 0.07 to 0.4 g/m$^2$, particularly preferably from 0.05 to 0.3 g/m$^2$, calculated in terms of the silver coated per m$^2$ of the photosensitive material. The amount of light-sensitive silver halide to the organic fatty acid silver salt is preferably from 0.01 to 0.2 mole, more preferably from 0.02 to 0.12 more, still more preferably from 0.03 to 0.07 mole, per mole of the organic fatty acid silver salt.

It is preferred in the invention that the silver halide is prepared in the absence of the organic fatty acid silver salt.

With respect to the method and condition for mixing the light-sensitive silver halide and the organic fatty acid silver salt prepared separately, there is a method of mixing the silver halide grain and the organic fatty acid silver salt after the preparation by a high-speed stirrer, a ball mill, a sand mill, a colloid mill, a vibration mill or a homogenizer. Also, a method of preparing the organic fatty acid silver salt wherein the light-sensitive silver halide after the preparation is mixed at an appropriate stage during the preparation of organic fatty acid silver salt.

The silver halide prepared independently from the organic fatty acid silver salt according to the method described above can provide a heat-developable photosensitive material being highly sensitive but having substantially no sensitivity after heat-development, which is the object of the invention.

On the other hand, a method of preparing silver halide wherein a halide is added to an organic fatty acid silver salt to conduct halidation of the organic fatty acid silver salt is also known. However, the method is disadvantageous because the high sensitivity cannot be obtained and the extent of decrease in sensitivity after heat-development is small.

A period for the addition of silver halide of the invention to a coating solution for image-forming layer is preferably from 180 minutes before coating to just before coating, and more preferably from 60 minutes before coating to 10 seconds before coating. A mixing method and mixing conditions for the silver halide of the invention with the coating solution are not particularly restricted as far as the effects of the invention can be sufficiently achieved.

Specific examples of the mixing method include a mixing method using a tank in which an average retention time calculated from an addition flow rate to the tank and a supply flow rate to a coater is controlled to the desired value, and a method of using a static mixer as described in N. Harnby, M. F. Edwards and A. W. Nienow, *Ekitai Kongou Gijutsu* (translated by Koji Takahashi), Chapter 8, The Nikkan Kogyo Shimbun, Ltd. (1989).

The photosensitive material may have any gradation, but it is preferred that an average contrast in the density ranging from 1.5 to 3.0 is from 1.5 to 10 in order to efficiently achieve the effects of the invention.

The term "average contrast" as used herein means a gradient of a line connecting a point having an optical density of 1.5 and a point having an optical density of 3.0 on a characteristic curve obtained by plotting a logarithm of a laser exposure amount, as the abscissa and an optical density of the photosensitive material exposed in the corresponding exposure amount and subjected to heat-development, as the ordinate.

The average contrast is preferably from 1.5 to 10 in view of improvement in a clear cut property of letter images. It is more preferably from 2.0 to 7, and still more preferably from 2.5 to 6.

The organic fatty acid silver salt for use in the invention is a silver salt, which is relatively stable to light but capable of forming a silver image when heated at a temperature of 80° C. or higher in the presence of an exposed photo-catalyst (e.g., a latent image of light-sensitive silver halide) and a reducing agent.

As the organic fatty acid silver salt, a silver salt of long-chain aliphatic carboxylic acid (having from 10 to 30 carbon atoms, preferably from 15 to 28 carbon atoms) is especially preferably used. Preferred examples of the fatty acid silver salt include silver behenate, silver arachidate, silver stearate, silver oleate, silver laurate, silver caprate, silver myristate, silver palmitate and a mixture thereof.

It is important that the silver salt of long-chain aliphatic carboxylic acid is incorporated into a photosensitive material in an amount of 5 times or more by mole based on the amount of silver halide in order to prepare the photosensitive material having substantially no sensitivity after heat-development.

Of the organic fatty acid silver salts, those having a silver behenate content of preferably not less than 50 mole %, more preferably not less than 80 mole %, and still more preferably not less than 90 mole %, are used in the invention.

It is important that the organic fatty acid silver salt for use in the invention has a shape having a large specific surface area.

The term "specific surface area" as used herein means a value obtained by dividing a surface area of an organic fatty acid silver salt grain by a volume of the organic fatty acid silver salt grain as described below. In practice, a volume weighted average value of respective grains is used as a representative characteristic value.

$$\text{Specific surface area } (\mu m^{-1}) = \text{surface area } (\mu m^2) / \text{volume } (\mu m^3)$$

The value of specific surface area is preferably not less than 10, more preferably not less than 15, and particularly preferably not less than 20. It has been found that by the use of organic fatty acid silver salt grain having a large specific surface area, the silver halide is dissolved during heat-development to provide a photosensitive material having substantially no sensitivity after the heat-development. The specific surface area of organic fatty acid silver salt grain can be determined using an electron micrograph.

The shape of organic fatty acid silver salt for use in the invention is not particularly restricted and may be in an acicular, rod-like, tabular or scaly form.

The organic fatty acid silver salt grain of scaly shape is particularly preferably used in the invention. The organic fatty acid silver salt grain of a short acicular shape having a ratio of the major axis to the minor axis of not more than 5, a rectangular solid or a cube, or an irregular shape like a potato is also preferably used. These organic fatty acid silver salt grains are characterized by providing reduced fog at the time of heat-development, in comparison with long acicular organic fatty acid silver salt grains having the ratio of the major axis to the minor axis of more than 5.

The term "organic fatty acid silver salt grain of scaly shape" as used herein is defined in the following manner. The organic fatty acid silver salt grain is observed by means of an electron microscope. The shape of organic fatty acid silver salt grain is approximated to a rectangular solid, and the side lengths of the rectangular solid are taken as a, b and c in ascending order (wherein c may be equal to b). Using shorter values, a and b, x is calculated as follows:

$$x=b/a$$

In such a manner, x values of about 200 grains are determined. When the grains satisfy a relation of x(average) ≧1.5, wherein x(average) represents an average of the x values determined, they are referred to as grains of scaly shape. The grains satisfying the relation of 30≧x(average) ≧1.5 are preferred, and those satisfying the relation of 20≧x(average) ≧2.0 are more preferred. On the other hand, the acicular grains are defined as grains satisfying the relation of 1≦x(average) <1.5.

In the scaly grain a can be regarded as a thickness of tabular grain having a plane with side of b and c as the principal plane. An average of the a value is preferably from 0.01 to 0.23 μm, and more preferably from 0.10 to 0.20 μm. An average of the c/b ratio is preferably from 1 to 6, more preferably from 1.05 to 4, still more preferably from 1.1 to 3, and particularly preferably from 1.1 to 2.

It is preferred that grain size distribution of the organic fatty acid silver salt is monodisperse. The monodisperse means that a percentage of value obtained by dividing standard deviations of the lengths of the minor axis and the major axis respectively by the averages for lengths of the minor axis and the major axes respectively is preferably not more than 100%, more preferably not more than 80%, and still more preferably not more than 50%. The shape of organic fatty acid silver salt can be determined from transmission electron microscopic images of a dispersion of the organic fatty acid silver salt.

For the production and dispersion of the organic fatty acid silver salt for use in the invention, known methods can be employed. Specifically, methods described, for example, in JP-A-10-62899, EP-A-803,763, EP-A-962,812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442, JP-A-2002-31870 and JP-A-2002-107868 can be referred to.

The presence of light-sensitive silver halide at the time of dispersing the organic fatty acid silver salt results in increase in fog and severe reduction in sensitivity. Therefore, it is preferable that the dispersion is carried out in the substantial absence of light-sensitive silver halide.

According to the invention, an amount of the light-sensitive silver halide dispersed in the aqueous dispersion is preferably not more than 1 mole %, and more preferably not more than 0.1 mole %, per mole of the organic fatty acid silver salt dispersed therein. Still more preferably, the light-sensitive silver halide is not added positively to the aqueous dispersion.

In the invention, it is possible to produce a photosensitive material by mixing an aqueous dispersion of the organic fatty acid silver salt with an aqueous dispersion of the light-sensitive silver halide. A mixing ratio of the organic fatty acid silver salt to the light-sensitive silver halide can be selected according to the desired purpose. A proportion of the light-sensitive silver salt to the organic fatty acid silver salt is preferably from 1 to 30 mole %, more preferably from 2 to 20 mole %, and particularly preferably from 3 to 15 mole %.

A method of mixing two or more aqueous organic fatty acid silver salt dispersions with two or more aqueous light-sensitive silver halide dispersions is preferably used in order to control the photographic characteristics.

The organic fatty acid silver salt can be used in a desired amount in the invention. Specifically, the amount of the organic fatty acid silver salt used is preferably from 0.1 to 5 $g/m^2$, more preferably from 0.3 to 3 $g/m^2$, and still more preferably from 0.5 to 2 $g/m^2$, calculated in terms of silver.

It is preferable for the heat-developable photosensitive material of the invention to contain a thermal developer, which is a reducing agent for the organic fatty acid silver salt. The reducing agent for organic fatty acid silver salt may be any substance (preferably any organic substance) capable of reducing a silver ion to metallic silver.

Examples of the reducing agent are described in JP-A-11-65021, paragraphs [0043] to [0045], and EP-A-803,764, from page 7, line 34 to page 18, line 12.

As the reducing agent for use in the invention, reducing agents of so-called hindered phenol type having a substituent on the o-position of a phenolic hydroxy group and reducing agents of bisphenol type are preferred. Of the reducing agents, compounds represented by the following formula (R) are more preferably used.

(R)

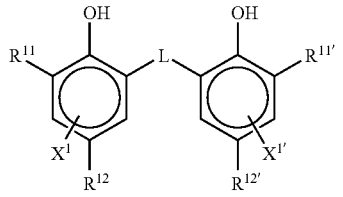

In formula (R), $R^{11}$ and $R^{11'}$ each independently represent an alkyl group having from 1 to 20 carbon atoms. $R^{12}$ and $R^{12'}$ each independently represent a hydrogen atom or a substituent capable of substituting on the benzene ring. L represents —S— or —$CHR^{13}$—. $R^{13}$ represents a hydrogen atom or an alkyl group having from 1 to 20 carbon atoms. $X^1$ and $X^{1'}$ each independently represent a hydrogen atom or a substituent capable of substituting on the benzene ring.

The formula (R) will be described in more detail below.

$R^{11}$ and $R^{11'}$ each independently represent a substituted or unsubstituted alkyl group having from 1 to 20 carbon atoms. The substituent for the alkyl group is not particularly restricted, and preferred examples of the substituent include an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group and a halogen atom.

$R^{12}$ and $R^{12'}$ each independently represent a hydrogen atom or a substituent capable of substituting on the benzene ring. $X^1$ and $X^{1'}$ also each independently represent a hydrogen atom or a substituent capable of substituting on the benzene ring. Suitable examples of the substituent capable of substituting on the benzene ring include an alkyl group, an aryl group, a halogen atom, an alkoxy group and an acylamino group.

L represents —S— or —$CHR^{13}$—. $R^{13}$ represents a hydrogen atom or an alkyl group having from 1 to 20 carbon atoms, which may have a substituent.

Examples of the unsubstituted alkyl group represented by $R^{13}$ include methyl, ethyl, propyl, butyl, heptyl, undecyl, isopropyl, 1-ethylpentyl and 2,4,4-trimethylpentyl groups. Examples of the substituent for the alkyl group include the same substituents as described for the alkyl group represented by $R^{11}$.

As $R^{11}$ or $R^{11'}$, a secondary or tertiary alkyl group having from 3 to 15 carbon atoms is preferred. Specific examples of such an alkyl group include isopropyl, isobutyl, tert-butyl, tert-amyl, tert-octyl, cyclohexyl, cyclopentyl, 1-methylcyclohexyl and 1-methylcyclopropyl groups.

The group more preferable for $R^{11}$ or $R^{11'}$ is a tertiary alkyl group having from 4 to 12 carbon atoms. Of the groups, tert-butyl, tert-amyl and 1-methylcyclohexyl groups are still more preferable, and a tert-butyl group is most preferred.

As $R^{12}$ or $R^{12'}$, an alkyl group having from 1 to 20 carbon atoms is preferred. Specific xamples of such an alkyl group include methyl, ethyl, propyl, butyl, isopropyl, tert-butyl, tert-amyl, cyclohexyl, 1-methylcyclohexyl, benzyl, methoxymethyl and ethoxyethyl groups. Of the groups, methyl, ethyl, propyl, isopropyl and tert-butyl groups are more preferred.

As $X^1$ or $X^{1'}$, a hydrogen atom, a halogen atom and an alkyl group are preferred, and a hydrogen atom is more preferred.

L is preferably —$CHR^{13}$—.

$R^{13}$ is preferably a hydrogen atom or an alkyl group having from 1 to 15 carbon atoms. Preferred examples of such an alkyl group include methyl, ethyl, propyl, isopropyl and 2,4,4-trimethylpentyl groups. A hydrogen atom, a methyl group, an ethyl group, a propyl group and an isopropyl group are particularly preferred for $R^{13}$.

When $R^{13}$ is a hydrogen atom, $R^{12}$ and $R^{12'}$ each represent preferably an alkyl group having from 2 to 5 carbon atoms, more preferably an ethyl group or a propyl group, and most preferably an ethyl group.

When $R^{13}$ is a primary or secondary alkyl group having from 1 to 8 carbon atoms, $R^{12}$ and $R^{12'}$ each preferably represent a methyl group. As the primary or secondary alkyl group having from 1 to 8 carbon atoms for $R^{13}$, methyl, ethyl, propyl or isopropyl group is more preferred, and methyl, ethyl or propyl group is still more preferred.

When $R^{11}$, $R^{11'}$, $R^{12}$ and $R^{12'}$ are all methyl groups, it is preferred that $R^{13}$ is a secondary alkyl group. In such a case, isopropyl, isobutyl or 1-ethylpentyl group is preferred as the secondary alkyl group for $R^{13}$, and an isopropyl group is more preferred.

The heat-developability and the color tone of developed silver may vary depending on the combination of $R^{11}$, $R^{11'}$, $R^{12}$, $R^{12'}$ and $R^{13}$ in the reducing agent described above. Since these characteristics can be adjusted by using two or more reducing agents in combination, it is preferred to use two or more reducing agents in combination depending on the intended purpose.

Specific examples of the reducing agent for use in the invention including the compound represented by formula (R) are set forth below, but the invention should not be construed as being limited thereto.

(I-1)

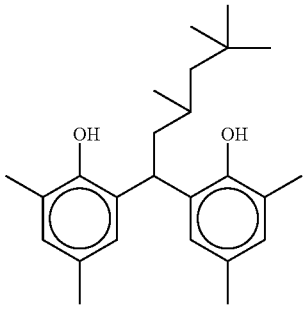

(I-2)

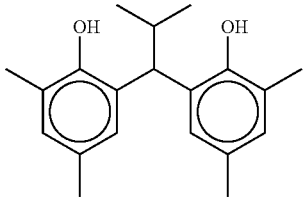

(I-3)

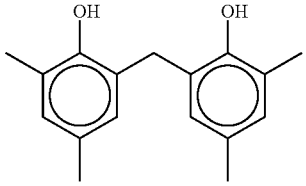

(I-4)

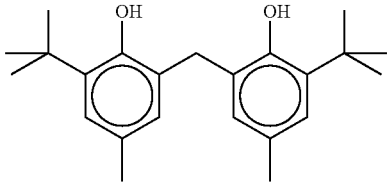

(I-5)

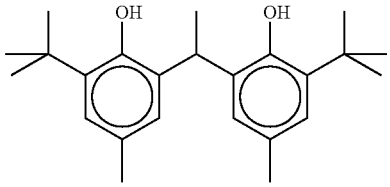

(I-6)

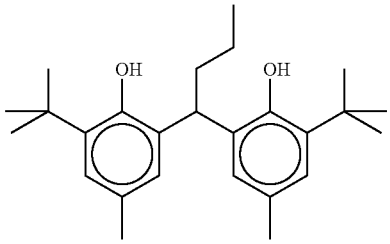

-continued
(I-7)
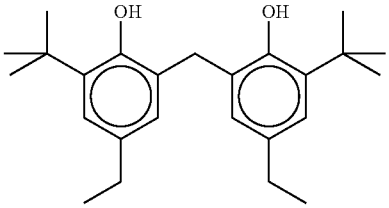
(I-8)
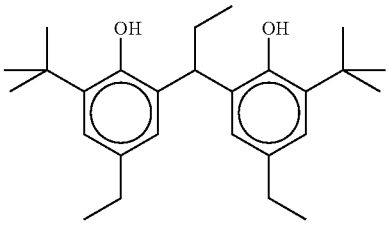
(I-9)
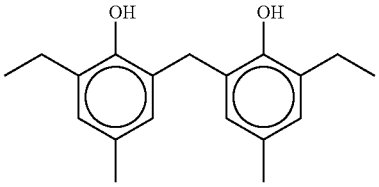
(I-10)
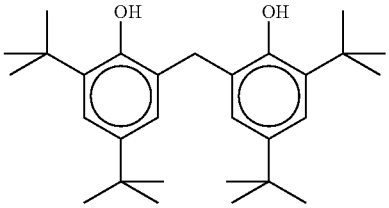
(I-11)
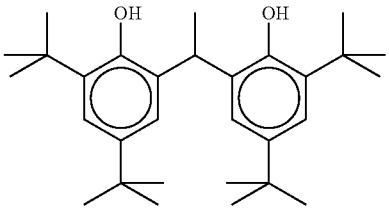
(I-12)
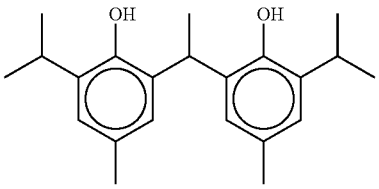
(I-13)
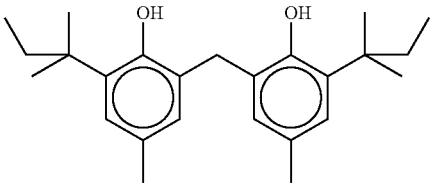
-continued
(I-14)
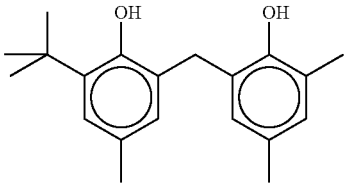
(I-15)
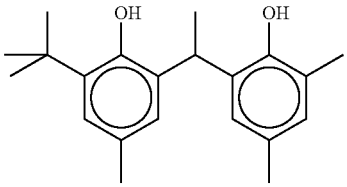
(I-16)
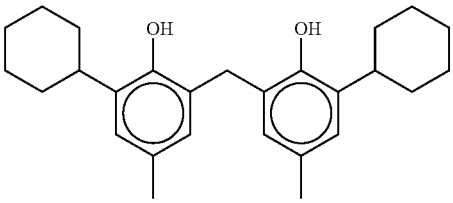
(I-17)
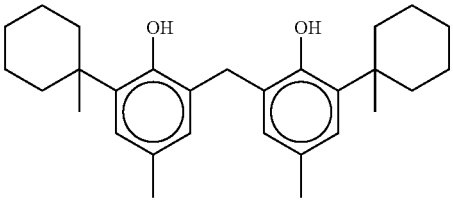
(I-18)
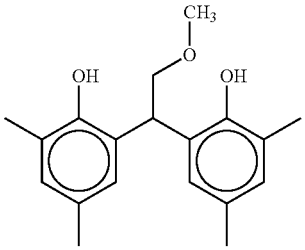
(I-19)
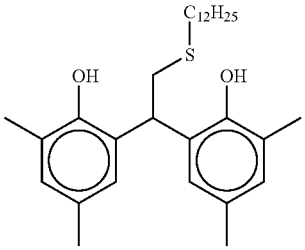
(I-20)
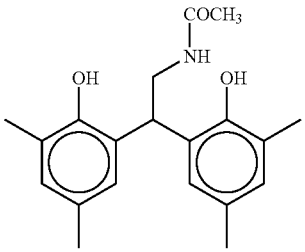

-continued
(I-21)
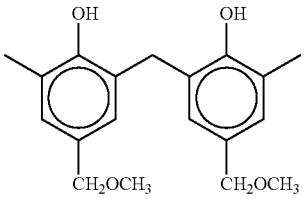
(I-22)
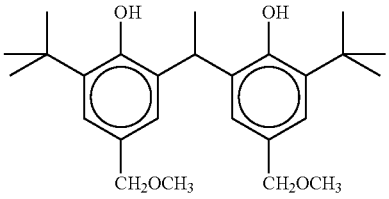
(I-23)
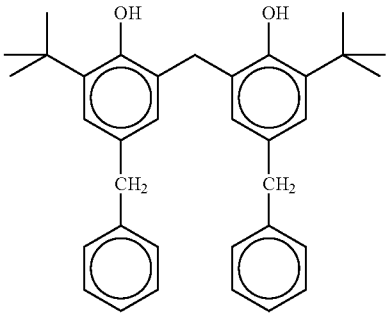
(I-24)
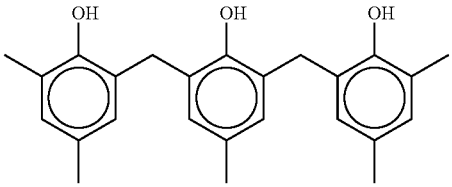
(I-25)
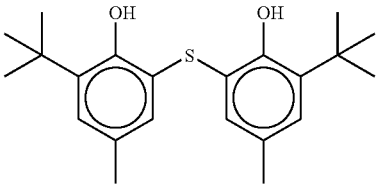
(I-26)
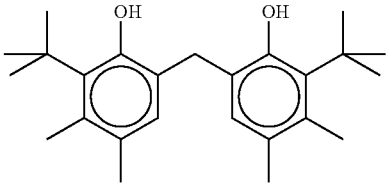
(I-27)
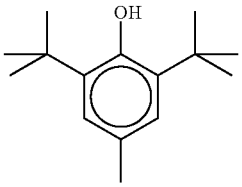
-continued
(I-28)
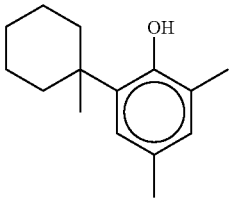
(I-29)
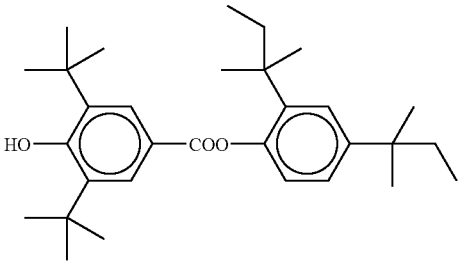
(I-30)
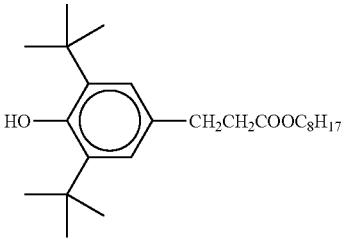
(I-31)
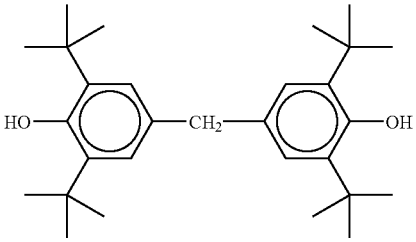
(I-32)
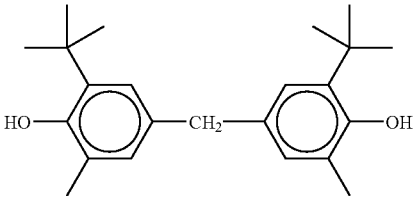
(I-33)
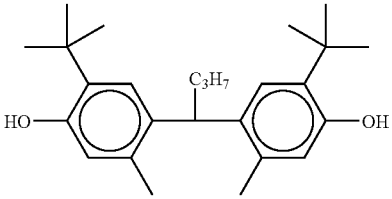

-continued (I-34)

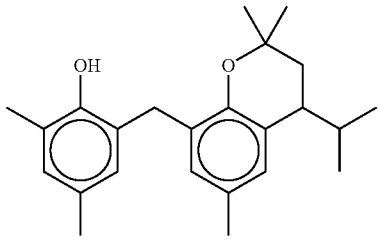

The amount of reducing agent used in the invention is preferably from 0.1 to 3.0 g/m$^2$, more preferably from 0.2 to 1.5 g/m$^2$, and still more preferably from 0.3 to 1.0 g/m$^2$.

The amount of reducing agent per mole of silver on the side having the image-forming layer is preferably from 5 to 50 mole %, more preferably from 8 to 30 mole %, and still more preferably from 10 to 20 mole %. It is preferred that the reducing agent is incorporated into the image-forming layer.

The reducing agent may be added to a coating solution in any form, for example, as a solution, emulsified dispersion or solid fine particle dispersion to incorporate into the photosensitive material of the invention.

According to a well-known emulsified dispersion method, the reducing agent is dissolved using an oil, for example, dibutyl phthalate, tricresyl phosphate, glyceryl triacetate or diethyl phthalate, and an auxiliary solvent, for example, ethyl acetate or cyclohexanone, and mechanically emulsified and dispersed to prepare an emulsified dispersion of the reducing agent.

According to a solid fine particle dispersion method, powder of the reducing agent is dispersed in an appropriate solvent, for example, water, by means of a ball mill, a colloid mill, a vibraton ball mill, a sand mill, a jet mill, a roller mill or ultrasonic wave, thereby preparing a solid dispersion of the reducing agent. The dispersion may be performed in the presence of a protective colloid (e.g., polyvinyl alcohol) or a surfactant (e.g., an anionic surfactant such as sodium triisopropylnaphthalenesulfonate, which is a mixture of isomers wherein the substitution positions of three isopropyl groups are different from each other). In the mills described above, beads such as zirconia beads are ordinarily used as dispersion media. Therefore, the dispersion may be contaminated with zirconium dissolved from the beads. The content of zirconium in the dispersion is ordinarily in the range of from 1 to 1,000 ppm, although it may vary depending on dispersion conditions. As far as the zirconium content in the photosensitive material is not higher than 0.5 mg per gram of silver, zirconium cause no problem in practice.

It is preferred to incorporate an antiseptic (e.g., sodium benzisothiazolinone) into an aqueous dispersion of the reducing agent.

The sulfonamidophenol compounds represented by formula (A) described in JP-A-2000-267222 and JP-A-2000-330234, the hindered phenol compounds represented by formula (II) described in JP-A-2001-92075, the hydrazine compounds represented by formula (I) described in JP-A-10-62895 and JP-A-11-15116 and formula (1) described in JP-A-2002-278017, and the phenol or naphthol compounds represented by formula (2) described in JP-A-2001-264929 are preferably used as a development accelerator in the heat-developable photosensitive material of the invention.

The development accelerator is used in an amount of from 0.1 to 20 mole %, preferably from 0.5 to 10 mole %, and more preferably from 1 to 5 mole %, based on the reducing agent used. The development accelerator can be incorporated into the photosensitive material in accordance with the same method as for the reducing agent. In particular, the development accelerator is preferably added as a solid dispersion or an emulsified dispersion.

In case of adding the development accelerator as the emulsified dispersion, it is preferred to prepare an emulsified dispersion by dispersing the development accelerator using a solvent having a high boiling point, which is a solid at ambient temperature, and an auxiliary solvent having a low boiling point, or to prepare a so-called oil-less emulsified dispersion by dispersing the development accelerator without using the solvent having a high boiling point.

Now, the hydrogen bond-forming compound preferably used in the invention is described below.

When the reducing agent for use in the invention has an aromatichydroxy group (—OH), especially in case of the bisphenol compound as described above, it is preferred to use a non-reducing compound having a group capable of forming a hydrogen bond with the hydroxy group in combination.

Examples of the group capable of forming a hydrogen bond together with a hydroxy group or an amino group include a phosphoryl group, a sulfoxido group, a sulfonyl group, a carbonyl group, an amido group, an ester group, an urethane group, an ureido group, a tertiary amino group and a nitrogen-containing aromatic group.

Of the compounds, those having a phosphoryl group, a sulfoxido group, an amido group (not having >N—H moiety but being blocked in the form of >N—Ra, wherein Ra is a substituent other than H), an urethane group (not having >N—H moiety but being blocked in the form of >N—Ra, wherein Ra is a substituent other than H) or an ureido group (not having >N—H moiety but being blocked in the form of >N—Ra, wherein Ra is a substituent other than H) are preferred.

The hydrogen bond-forming compound particularly preferably used in the invention is a compound represented by the following formula (D):

(D)

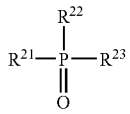

In formula (D), $R^{21}$ to $R^{23}$ each independently represent an alkyl group, an aryl group, an alkoxy group, an aryloxy group, an amino group or a heterocyclic group, each of which may be unsubstituted or may have a substituent.

Examples of the substituent for the group represented by any one of $R^{21}$ to $R^{23}$ include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Of the groups, an alkyl group and an aryl group, for example, methyl, ethyl, isopropyl, tert-butyl, tert-octyl, phenyl, 4-alkoxyphenyl and 4-acyloxyphenyl groups, are preferred as the substituent.

Specific examples of the alkyl group for any one of $R^{21}$ to $R^{23}$ include methyl, ethyl, butyl, octyl, dodecyl, isopropyl, tert-butyl, tert-amyl, tert-octyl, cyclohexyl, 1-methylcyclohexyl, benzyl, phenethyl and 2-phenoxypropyl groups.

Examples of the aryl group for any one of $R^{21}$ to $R^{23}$ include phenyl, cresyl, xylyl, naphthyl, 4-t-butylphenyl, 4-tert-octylphenyl, 4-anisidyl and 3,5-dichlorophenyl groups.

Examples of the alkoxy group for any one of $R^{21}$ to $R^{23}$ include methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups.

Examples of the aryloxy group for any one of $R^{21}$ to $R^{23}$ include phenoxy, cresyloxy, isopropylphenoxy, 4-tert-butylphenoxy, naphthoxy and biphenyloxy groups.

Examples of the amino group for anyone of $R^{21}$ to $R^{23}$ include dimethylamino, diethylamino, dibutylamino, dioctylamino, N-methyl-N-hexylamino, dicyclohexylamino, diphenylamino and N-methyl-N-phenylamino groups.

An alkyl group, an aryl group, an alkoxy group or an aryloxy group is preferred for any one of $R^{21}$ to $R^{23}$. From the viewpoint of effects achieved by the invention, it is preferable that at least one of $R^{21}$, $R^{22}$ and $R^{23}$ represents an alkyl group or an aryl group, and it is more preferable that at least two of $R^{21}$, $R^{22}$ and $R^{23}$ represent each an alkyl group or an aryl group. From the viewpoint of availability of compound at low price, it is preferred that $R^{21}$, $R^{22}$ and $R^{23}$ are the same groups.

Specific examples of the hydrogen bond-forming compound for use in the invention including the compound represented by formula (D) are set forth below, but the invention should not be construed as being limited thereto.

(II-1)

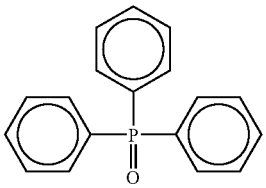

(II-2)

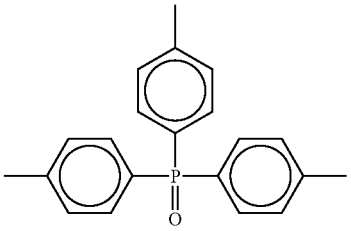

(II-3)

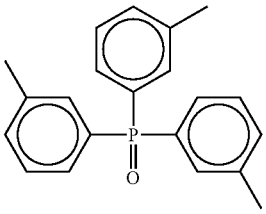

-continued (I-4)

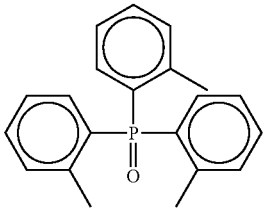

(II-5)

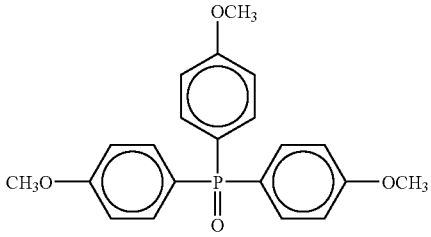

(II-6)

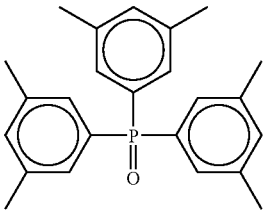

(II-7)

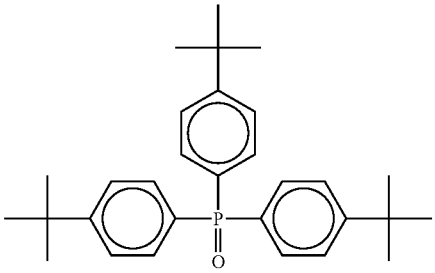

(II-8)

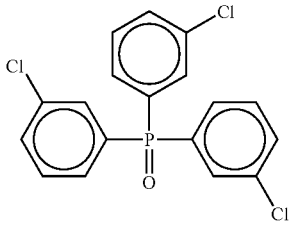

(II-9)

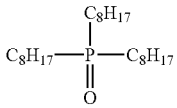

(II-10)

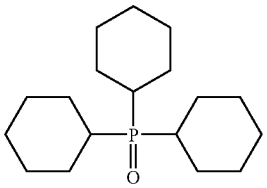

-continued (II-11)

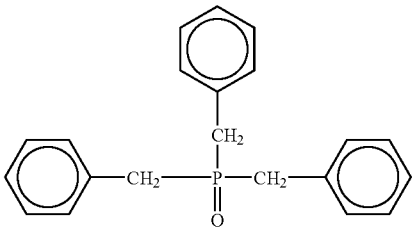

(II-12)

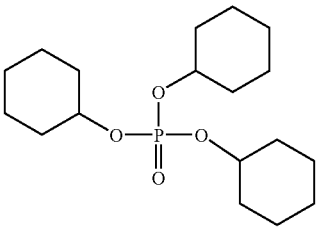

(II-13)

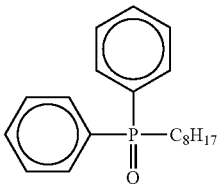

(II-14)

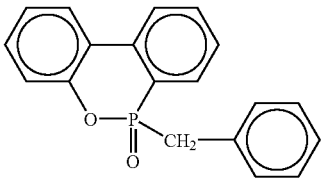

(II-15)

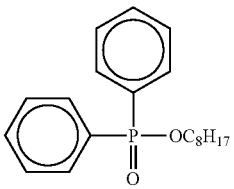

(II-16)

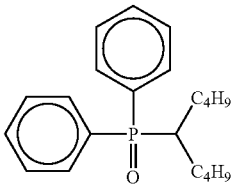

(II-17)

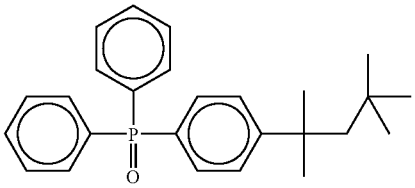

(II-18)

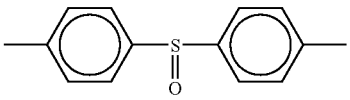

-continued (II-19)

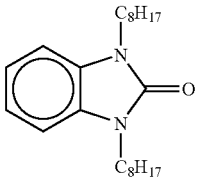

(II-20)

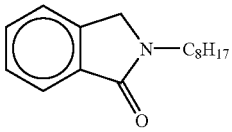

(II-21)

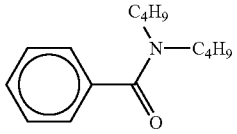

In addition to the compounds set forth above, specific examples of the hydrogen bond-forming compound include the compounds described in European Patent No. 1,096,310, JP-A-2002-156727 and JP-A-2002-318431.

The compound represented by formula (D) for use in the invention can be added to a coating solution in the form of a solution, an emulsified dispersion or a solid fine particle dispersion to incorporate into the photosensitive material in a manner similar to the reducing agent. The compound represented by formula (D) may form a complex including hydrogen bond with a compound having a phenolic hydroxyl group or an amino group in a solution state. Depending on a combination of the reducing agent and the compound represented by formula (D), the complex can be isolated in the form of crystal. The use of the isolated crystal powder as a solid fine particle dispersion is particularly preferred from the viewpoint of achieving stable performances. It is also preferred to employ a method in which the reducing agent and the compound of formula (D) are mixed in the form of powder and the mixture is dispersed using an appropriate dispersant by an apparatus, for example, a sand grinder mill, whereby the complex thereof is formed.

The compound represented by formula (D) is preferably used in an amount of from 1 to 200 mole %, more preferably from 10 to 150 mole %, and still more preferably from 20 to 100 mole %, based on the reducing agent.

Now, the binder for use in the invention is described below.

Any polymer may be used as a binder for an organic fatty acid silver salt-containing layer. The binder is preferably transparent or translucent, and ordinarily colorless. Examples of the binder include natural resins, polymers and copolymers, synthetic resins, polymers and copolymers, and other film-forming media, for example, gelatins, rubbers, polyvinyl alcohols, hydroxyethyl celluloses, cellulose acetates, cellulose acetate butyrates, polyvinyl pyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal or polyvinyl butyral), polyesters, polyurethanes, phenoxy resins, polyvinylidene chlorides, polyepoxides, polycarbonates, polyvinyl acetates, polyolefins, cellulose esters and polyamides. The binder may forma coating film using water, an organic solvent or an emulsion.

A glass transition temperature of the binder for use in the organic fatty acid silver salt-containing layer is preferably from 10 to 80° C. (hereinafter, the binder having a glass transition temperature in such a temperature range is also referred to as a high Tg binder sometimes), more preferably from 15 to 70° C., and still more preferably from 20 to 65° C.

The term "Tg" as used herein is determined according to the following equation:

$$1/Tg=\Sigma(Xi/Tgi)$$

wherein, assuming that the polymer is a copolymer composed of n monomers from i=1 to i=n, Xi is a weight fraction of the ith monomer (ΣXi=1) and Tgi is a glass transition temperature (absolute temperature) of a homopolymer formed from the ith monomer. The symbol Σ means the sum of i=1 to i=n.

The value of glass transition temperature of a homopolymer formed from each monomer (Tgi) is quoted from J. Brandrup and E. H. Immergut, *Polymer Handbook*, 3rd. Edition, Wiley-Interscience (1989).

Two or more binders may be used in combination, if desired. Further, a binder having a glass transition temperature of not less than 20° C. and a binder having a glass transition temperature of less than 20° C. may be used in combination. When two or more polymers having a Tg different from each other are used in combination, it is preferred that a weight average Tg is within the above-described range.

In the invention, it is preferred that the organic fatty acid silver salt-containing layer is formed by applying a coating solution wherein at least 30 weight % of the solvent thereof is water and drying to form a film.

Enhanced performances can be achieved in the invention, when the organic fatty acid silver salt-containing layer is formed by applying and drying a coating solution containing water in a proportion of at least 30 weight % based on the total amount of solvent used, further when a binder used in the organic fatty acid silver salt-containing layer is capable of being dissolved or dispersed in a water-based solvent (aqueous solvent), and particularly when a binder comprising a latex of polymer having an equilibrium moisture content of not more than 2 weight % under conditions of 25° C. and 60% RH. According to the most preferable embodiment, a latex of polymer prepared so as to have an ionic conductivity of not more than 2.5 mS/cm is used. The preparation of such a latex can be conducted by purification of a synthesized polymer using a separation membrane.

The term "water-based solvent" as used herein, in which a binder can be dissolved or dispersed, means and includes water and a mixture of water and a water-miscible organic solvent in an amount of not mote than 70 weight %.

Examples of the water-miscible organic solvent include an alcohol solvent, for example, methyl alcohol, ethyl alcohol or propyl alcohol, a cellosolve solvent, for example, methyl cellosolve, ethyl cellosolve or butyl cellosolve, ethyl acetate and dimethylformamide.

The term "water-based solvent" is also used for a solvent in which the polymer is not thermodynamically dissolved but present in a so-called dispersed state.

The term "equilibrium moisture content under conditions of 25° C. and 60% RH" can be defined by the following equation using a weight of a polymer under a moisture equilibrium at atmosphere of 25° C. and 60% RH, W1, and a weight of the polymer in the absolutely dried state at 25° C., W0:

$$\text{Equilibrium moisture content under 25° C. and 60\% RH(weight \%)}=\{(W1-W0)/W0\}\times 100$$

On the definition of the moisture content and the method for measuring thereof, for example, Koubunshi Gakkai ed., Koubunshi Kougaku Kouza, Vol. 14, *Kobunshi Zairyo Shikenho* ChijinShokan Co., Ltd. can be referred to.

The equilibrium moisture content of the binder polymer under conditions of 25° C. and 60% RH is preferably not more than 2 weight %, more preferably from 0.01 to 1.5 weight %, and still more preferably from 0.02 to 1.0 weight %.

A polymer dispersible in the water-based solvent is particularly preferred as the binder used in the invention. Examples of the polymer in a dispersed state include a latex in which fine particles of a water-insoluble, hydrophobic polymer are dispersed, and a dispersion in which a polymer molecule is dispersed in a molecular state or in the form of micelle. Particles dispersed in a latex form are preferred.

An average diameter of the particles dispersed is from 1 to 50,000 nm, preferably from 5 to 1,000 nm, more preferably from 10 to 500 nm, and still more preferably from 50 to 200 nm. With respect to diameter distribution of the dispersed particles is not particularly restricted, and both particles of broad diameter distribution and particles of monodispersed diameter distribution may be used. A mixture of two or more polymer particles each having monodispersed diameter distribution is also preferably used from the viewpoint of controlling physical properties of the coating solution.

Preferred examples of the polymer dispersible in the water-based solvent for use in the invention include a hydrophobic polymer, for example, an acrylic polymer, a polyester, a rubber (e.g., SBR resin), a polyurethane, a polyvinyl chloride, a polyvinyl acetate, a polyvinylidene chloride and a polyolefin. The polymer may be a straight chain, branched or crosslinked polymer, and it may also be a polymer obtained by polymerization of a single-kind monomer, namely a so-called homopolymer, or a copolymer obtained by polymerization of two or more kinds of monomers. In case of the copolymer, both a random copolymer and a block copolymer can be used.

A number average molecular weight of the polymer is preferably from 5,000 to 1,000,000, and more preferably from 10,000 to 200,000. When the molecular weight is too low, the mechanical strength of the organic fatty acid silver salt-containing layer becomes insufficient, while too high molecular weight is undesirable because of poor film formability. A cross-linkable polymer latex is particularly preferably used.

Preferred examples of the polymer latex are set forth below, but the invention should not be construed as being limited to thereto.

In the following examples, each latex is represented using a monomer as a starting material, each figure in parentheses expresses content of each monomer by weight %, and each molecular weight indicates a number average molecular weight. When polyfunctional monomer is used, the concept of molecular weight cannot be applied to the resulting polymer because a cross-linked structure is formed therein. In such a case, therefore, a latex is described as cross-linking and the description of molecular weight is omitted. Tg represents a glass transition temperature.

P-1; -MMA(70)-EA(27)-MAA(3)-latex (molecular weight: 37,000, Tg: 61° C.)

P-2; -MMA(70)-2EHA(20)-St(5)-AA(5)-latex (molecular weight: 40,000, Tg: 59° C.)

P-3; -St(50)-Bu(47)-MAA(3)-latex (cross-linking, Tg: −17° C.)

P-4; -St(68)-Bu(29)-AA(3)-latex (cross-linking, Tg: 17° C.)

P-5; -St(71)-Bu(26)-AA(3)-latex (cross-linking, Tg: 24° C.)

P-6; -St(70)-Bu(27)-IA(3)-latex (cross-linking)

P-7; -St(75)-Bu(24)-AA(1)-latex (cross-linking, Tg: 29° C.)

P-8; -St(60)-Bu(35)-DVB(3)-MAA(2) latex (cross-linking)

P-9; -St(70)-Bu(25)-DVB(2)-AA(3)-latex (cross-linking)

P-10; -VC(50)-MMA(20)-EA(20)-AN(5)-AA(5)-latex (molecular weight: 80,000)

P-11; -VDC(85)-MMA(5)-EA(5)-MAA(5)-latex (molecular weight: 67,000)

P-12; -Et(90)-MAA(10)-latex (molecular weight: 12,000)

P-13; -St(70)-2EHA(27)-AA(3)-latex (molecular weight: 130,000, Tg: 43° C.)

P-14; -MMA(63)-EA(35)-AA(2)-latex (molecular weight: 33,000, Tg: 47° C.)

P-15; -St(70.5)-Bu(26.5)-AA(3)-latex (cross-linking, Tg: 23° C.)

P-16; -St(69.5)-Bu(27.5)-AA(3)-latex (cross-linking, Tg: 20.5° C.)

The abbreviations used in the above formulae represent the following monomers respectively. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latices described above include those commercially available, and the following products can be utilized. Examples of acrylic polymer product include Sebian A-4635, 4718 and 4601 (produced by Daicel Chemical Industries, Ltd.), and Nipol Lx811, 814, 821, 820 and 857 (produced by Zeon Corp.). Examples of polyester product include FINETEX ES650, 611, 675 and 850 (produced by Dainippon Ink and Chemicals, Inc.), and WD-size and WMS (produced by Eastman Chemical Co.) Examples of polyurethane product include HYDRAN AP10, 20, 30 and 40 (produced by Dainippon Ink and Chemicals, Inc.). Examples of rubber product include LACSTAR 7310K, 3307B, 4700H AND 7132C (produced by Dainippon Ink and Chemicals, Inc.), and Nipol Lx416, 410, 438C and 2507 (produced by Zeon Corp.). Examples of polyvinyl chloride product include G351 and G576 (produced by Zeon Corp.). Examples of polyvinylidene chloride product include L502 and L513 (produced by Asahi Kasei Corporation). Examples of polyolefin product include Chemipearl S120 and SA100 (produced by Mitsui Chemicals, Inc.).

The polymer latices may be used individually, or a blend of two or more polymer latices may be used, if desired.

As the polymer latex for use in the invention, a styrene-butadiene copolymer latex is particularly preferred. A weight ratio of styrene unit to butadiene unit in the styrene-butadiene copolymer is preferably from 40:60 to 95:5. Also, it is preferred that the total amount of styrene unit and butadiene unit is from 60 to 99 weight % of the copolymer. Further, the polymer latex for use in the invention preferably contains acrylic acid unit or methacrylic acid unit in an amount of from 1 to 6 weight %, and more preferably from 2 to 5 weight %, based on the sum total of styrene unit and butadiene unit. It is preferred that the polymer latex of the invention includes an acrylic acid unit.

Examples of the styrene-butadiene-acid copolymer latex preferably used in the invention include the above-described P-3 to P-8, P-15 and P-16, and LACSTAR 3307B, LACSTAR 7132C and Nipol Lx416 as the commercially available products.

A Tg range of the styrene-butadiene-acid copolymer latex is preferably from 10° C. to 30° C., and more preferably from 17° C. to 25° C.

To the organic fatty acid silver salt-containing layer of photosensitive material of the invention may be added a hydrophilic polymer, for example, gelatin, polyvinyl alcohol, methyl cellulose, hydroxypropyl cellulose or carboxymethyl cellulose. An amount of the hydrophilic polymer added is preferably not more than 30 weight %, and more preferably not more than 20 weight %, of the total binder in the organic fatty acid silver salt-containing layer.

It is preferable that the organic fatty acid silver salt-containing layer (or an image-forming layer) is a layer formed using a polymer latex. A weight ratio of the total binder to the organic fatty acid silver salt in the organic fatty acid silver salt-containing layer is preferably from 1/10 to 10/1, more preferably from 1/3 to 5/1, and still more preferably from 1/1 to 3/1.

Ordinarily, the organic fatty acid silver salt-containing layer is also a light-sensitive layer (an emulsion layer) containing light-sensitive silver halide as a light-sensitive silver salt. In such a case, A weight ratio of the total binder to the silver halide is preferably from 5/1 to 400/1, and more preferably from 10/1 to 200/1.

The amount of total binder contained in the image-forming layer is preferably from 0.2 to 30 g/m$^2$, more preferably from 1 to 15 g/m$^2$, and still more preferably from 2 to 10 g/m$^2$. To the image-forming layer may be added an additive, for example, a cross-linking agent for crosslinking and a surfactant for improving coating property.

(Preferable Solvent for Coating Solution)

A solvent (herein, both a solvent and a dispersing medium are collectively referred to as a solvent for simplicity's sake) of a coating solution for the organic fatty acid silver salt-containing layer of photosensitive material of the invention is a water-based solvent containing at least 30 weight % water.

As a solvent component other than water, a water-miscible organic solvent, for example, methyl alcohol, ethyl alcohol, isopropyl alcohol, methyl cellosolve, ethyl cellosolve, dimethylformamide or ethyl acetate, maybe appropriately used. The water content in the solvent for coating solution is preferably not less than 50 weight %, and more preferably not less than 70 weight %.

Preferred examples of the solvent include water, water/methyl alcohol=90/10, water/methyl alcohol=70/30. water/methyl alcohol/dimethylformamide=80/15/5, water/methyl alcohol/ethyl cellosolve=85/10/5, and water/methyl alcohol/isopropyl alcohol=85/10/5 (wherein the figures represent percents by weight, respectively).

Now, an antifoggant for use in the invention is described below.

The antifoggant, stabilizer and precursor of stabilizer, which can be used in the invention, include the compounds described in the patents cited in JP-A-10-62899, paragraph [0070] and EP-A-803,764, page 20, line 57 to page 21, line 7, the compounds described in JP-A-9-281637 and JP-A-9-329864, the compounds described in U.S. Pat. No. 6,083,681 and European Patent 1,048,975.

The antifoggant preferably used in the invention is an organic halogen compound. Examples of the organic halogen compound include the compounds described in JP-A-11-65021, paragraphs [0111] and [0112]. In particular, the organic halogen compounds represented by formula (P) in JP-A-2000-284399, the organic polyhalogen compounds represented by formula (II) in JP-A-10-339934, and the organic polyhalogen compounds described in JP-A-2001-31644 and JP-A-2001-33911 are preferred.

The organic polyhalogen compound preferably used in the invention is described in more detail below.

The polyhalogen compound preferably used in the invention includes a compound represented by the following formula (H):

$$Q-(Y)_n-C(Z_1)(Z_2)X \quad (H)$$

In formula (H), Q represents an alkyl group, an aryl group or a heterocyclic group; Y represents a divalent connecting group; n represents 0 or 1; $Z_1$ and $Z_2$ each represent a halogen atom; and X represents a hydrogen atom or an electron withdrawing group.

In formula (H), Q preferably represents a phenyl group substituted with an electron withdrawing group having a positive value of the Hammett's substituent constant. With respect to the Hammett's substituent constant, *Journal of Medicinal Chemistry*, Vol. 16, No. 11, pages 1207-1216 (1973) can be referred to.

Examples of the electron withdrawing group include a halogen atom (e.g., fluorine atom (σp value: 0.06), chlorine atom (σp value: 0.23), bromine atom (σp value: 0.23), or iodine atom (σp value: 0.18)), a trihalomethyl group (e.g., tribromomethyl (σp value: 0.29), trichloromethyl (σp value: 0.33), or trifluoromethyl (σp value: 0.54)), a cyano group (σp value: 0.66), a nitro group (σp value: 0.78), an aliphatic sulfonyl, arylsulfonyl or heterocyclic sulfonyl group (e.g., methanesulfonyl (σp value: 0.72)), an aliphatic acyl, arylacyl or heterocyclic acyl group (e.g., acetyl (σp value: 0. 50), or benzoyl (σp value: 0.43)), an alkynyl group (e.g., —C≡CH (σp value: 0.23)), an aliphatic oxycarbonyl, aryloxycarbonyl or heterocyclic oxycarbonyl group (e.g., methoxycarbonyl (σp value: 0.45)), or phenoxycarbonyl (σp value: 0.44)),a carbamoyl group (σp value: 0.36), a sulfamoyl group (σp value: 0.57), a sulfoxide group, a heterocyclic group, and a phosphoryl group. The σp value is preferably in the range of from 0.2 to 2.0, and more preferably from 0.4 to 1.0.

Of the electron withdrawing groups, a carbamoyl group, an alkoxycarbonyl group, an alkylsulfonyl group and an alkylphosphoryl group are preferred. A carbamoyl group is most preferred.

X is preferably an electron withdrawing group, more preferably a halogen atom, an aliphatic sulfonyl group, an arylsulfonyl group, a heterocyclic sulfonyl group, an aliphatic acyl group, an arylacyl group, a heterocyclic acyl group, an aliphatic oxycarbonyl group, an aryloxycarbonyl group, a heterocyclic oxycarbonyl group, a carbamoyl group or a sulfamoyl group, and particularly preferably a halogen atom. Of the halogen atoms, a chlorine atom, a bromine atom and an iodine atom are preferred, a chlorine atom and a bromine atom are more preferred, and a bromine atom is particularly preferred.

Y is preferably —C(=O)—, —SO— or —$SO_2$—, more preferably —C(=O)— or —$SO_2$—, and particularly preferably —$SO_2$—.

n is 0 or 1, and preferably 1.

Specific examples of the compound represented by formula (H) for use in the invention are set forth below.

(III-1)

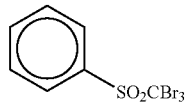

(III-2)

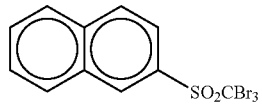

(III-3)

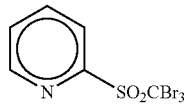

(III-4)

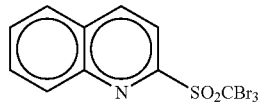

(III-5)

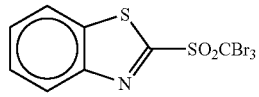

(III-6)

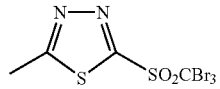

(III-7)

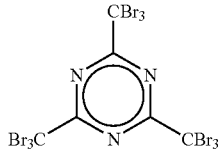

(III-8)

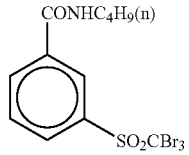

(III-9)

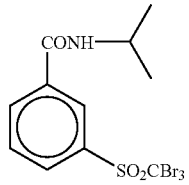

(III-10)

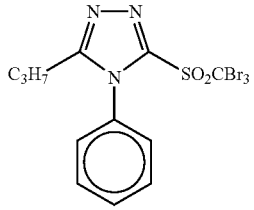

-continued (III-11)

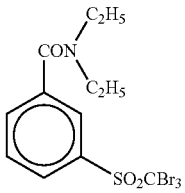

(III-12)

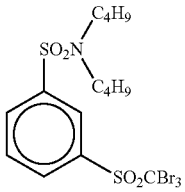

(III-13)

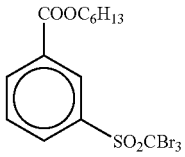

(III-14)

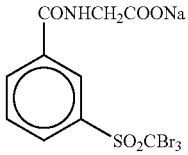

(III-15)

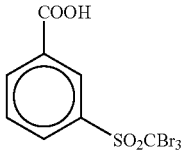

(III-16)

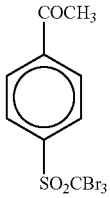

(III-17)

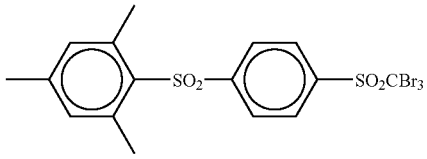

(III-18)

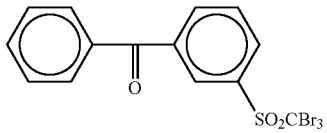

(III-19)

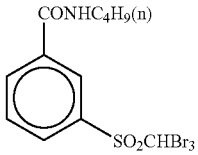

-continued (III-20)

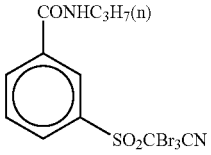

(III-21)

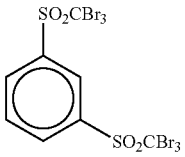

(III-22)

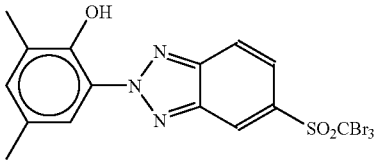

(III-23)

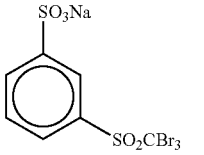

(III-24)

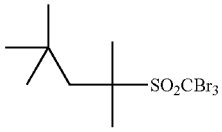

The compound represented by formula (H) for use in the invention is preferably used in an amount of from $1\times10^{-4}$ to 0.5 mole, more preferably from $1\times10^{-3}$ to 0.1 mole, and still more preferably from $5\times10^{-3}$ to 0.05 mole, per mole of the light-insensitive organic fatty acid silver salt in the image-forming layer.

As a method for incorporating the antifoggant into the photosensitive material, the methods as described above for the reducing agent can be employed. A method of adding in the form of solid fine particle dispersion is also preferred for the organic polyhalogen compound.

Examples of other antifoggants include the mercury (II) salts described in JP-A-11-65021, paragraph [0113], the benzoic acids described in JP-A-11-65021, paragraph [0114], the salicylic acid derivatives described in JP-A-2000-206642, the formaldehyde scavenger compounds represented by formula (S) in JP-A-2000-221634, the triazine compounds described in claim 9 of JP-A-11-352624, the compounds represented by formula (III) in JP-A-6-11791, and 4-hydroxy-6-methyl-1,3,3a,7-tetraazaindene.

The heat-developable photosensitive material of the invention may contain an azolium salt for the purpose of preventing fog. Examples of the azolium salt include the compounds represented by formula (XI) in JP-A-59-193447, the compounds described in JP-B-55-12581, and the compounds represented by formula (II) described in JP-A-60-153039. Although the azolium salt may be added to any portion of the photosensitive material, it is preferably added to a layer present on the light-sensitive layer side. More preferably, it is added to the organic fatty acid silver salt-containing layer.

The addition of azolinium salt may be carried out at any step in the preparation of a coating solution. In case of adding the azolinium salt to the organic fatty acid silver salt-containing layer, it may be added in any step from the preparation of organic fatty acid silver salt to the preparation of coating solution, but preferably at a period after the preparation of organic fatty acid silver salt but just before the coating. The azolium salt may be added by any method, for example, a method of adding in the form of powder, solution or fine particle dispersion. It may also be added as a solution of a mixture with other additives, for example, a sensitizing dye, a reducing agent or a toning agent.

An amount of the azolium salt added in the invention is not particularly restricted, and preferably from $1\times10^{-6}$ to 2 moles, and more preferably from $1\times10^{-3}$ to 0.5 moles, per mole of silver.

Into the photosensitive material of the invention, a mercapto compound, a disulfide compound or a thione compound can be incorporated for the purposes of controlling the development through restrain or acceleration, enhancing the efficiency of spectral sensitization and improving the preservability before and after the development. Examples of such a compound include the compounds described in JP-A-10-62899, paragraphs [0067] to [0069], the compounds represented by formula (I) in JP-A-10-186572 and the specific examples thereof set forth in paragraphs [0033] to [0052], and the compounds described in EP-A-803,764, page 20, lines 36 to 56. The mercapto-substituted aromatic heterocyclic compounds as described in JP-A-9-297367, JP-A-9-304875 and JP-A-2001-100358 are particularly preferred.

It is preferred to add a toning agent to the heat-developable photosensitive material of the invention. Examples of the toning agent are described in JP-A-10-62899, paragraphs [0054] to [0055], EP-A-803,764, page 21, lines 23 to 48, JP-A-2000-356317 and JP-A-2000-187298. Specifically, a phthalazinone (for example, phthalazinone, a phthalazinone derivative or a metal salt thereof, e.g. 4-(1-naphthyl)phthalazinone, 6-chlorophthalazinone, 5,7-dimethoxyphthalazinone or 2,3-dihydro-1,4-phthalazinedione), a combination of a phthalazinone and a phthalic acid (e.g., phthalic acid, 4-methylphthalic acid, 4-nitrophthalic acid, diammonium phthalate, sodium phthalate, potassium phthalate or tetrachlorophthalic anhydride), a phthalazine (for example, phthalazine, a phthalazine derivative or a metal salt thereof, e.g., 4-(1-naphthyl)phthalazine, 6-isopropylphthalazine, 6-tert-butylphthalazine, 6-chlorophthalazine, 5,7-dimethoxyphthalazine or 2,3-dihydrophthalazine), and a combination of a phthalazine and a phthalic acid are preferably used. The combination of a phthalazine and a phthalic acid is more preferred. In particular a combination of 6-isopropylphthalazine and phthalic acid or 4-methylphthalic acid is preferably used.

A plasticizer and a lubricant for use in the light-sensitive layer of photosensitive material of the invention is described in JP-A-11-65021, paragraph [0117]. An ultra-high contrast-providing agent for the formation of ultra-high contrast image, and the addition method and amount thereof, which can be used in the light-sensitive layer of photosensitive material of the invention, are described in JP-A-11-65021, paragraph [0118], JP-A-11-223898, paragraphs [0136] to [0193], and include the compounds represented by formula (H), formulae (1) to (3), and formulae (A) and (B) in JP-A-2000-284399 and the compounds represented by formulae (III) to (V) (the specific compounds of [Ka-21] to [Ka-24]) in JP-A-2000-347345. An ultra-high contrast accelerator, which can be used in the light-sensitive layer of photosensitive material of the invention, is described in JP-A-11-65021, paragraph [0102], and JP-A-11-223898, paragraphs [0194] to [0195].

In case of using formic acid or a salt thereof as a strong fogging substance, it is preferably used in an amount of not more than 5 millimoles, and more preferably not more than 1 millimole, per mole of silver on the side of the image-forming layer containing light-sensitive silver halide.

When the ultra-high contrast-providing agent is used in the heat-developable photosensitive material of the invention, it is preferable to use an acid formed by hydration of diphosphorus pentoxide or a salt thereof in combination therewith.

Examples of the acid formed by hydration of diphosphorus pentoxide and salt thereof include metaphosphoric acid (metaphosphate), pyrophosphoric acid (pyrophosphate), orthophosphoric acid (orthophosophate), triphosphoric acid (triphosphate), tetraphosphoric acid (tetraphosphate) and hexametaphosphoric acid (hexametaphosphate).

Of the acids formed by hydration of diphosphorus pentoxide and salt thereof, orthophosphoric acid (orthophosphate) and hexametaphosphoric acid (hexametaphosphate) are particularly preferably used.

Specific examples of the salt include sodium orthophosphate, sodium dihydrogen orthophosphate, sodium hexametaphosphate and ammonium hexametaphosphate.

An amount of the acid formed by hydration of diphosphorus pentoxide and salt thereof (coverage per $m^2$ of the photosensitive material) may be appropriately determined considering characteristics, for example, sensitivity and fog. Specifically, the amount is preferably from 0.1 to 500 $mg/m^2$, and more preferably from 0.5 to 100 $mg/m^2$.

The heat-developable photosensitive material of the invention can be provided with a surface protective layer for the purpose of preventing adhesion of the image-forming layer. The surface protective layer may be a single layer or a multiple layer. With respect to the surface protective layer, the descriptions in JP-A-11-65021, paragraphs [0119] to [0120], and JP-A-2000-171936 are referred to.

As a binder for the surface protective layer of the invention, gelatin is preferably used. It is also preferred to use polyvinyl alcohol (PVA) alone or in combination with gelatin. As to the gelatin, inert gelatin (e.g. Nitta Gelatin 750) and phthalated gelatin (e.g., Nitta Gelatin 801) can be used.

Examples of the PVA usable include those described in JP-A-2000-171936, paragraphs [0009] to [0020]. Preferably, PVA-105 as a completely saponified product, PVA-205 and PVA-335 as partially saponified products, and MP-203 as a modified polyvinyl alcohol product (which are trade names and available from Kuraray Co., Ltd.) are employed. The coverage (per $m^2$ of a support) of polyvinyl alcohol for each of the protective layer is preferably from 0.3 to 4.0 $g/m^2$, and more preferably from 0.3 to 2.0 $g/m^2$.

In the case where the heat-developable photosensitive material of the invention is used for printing purpose wherein dimensional stability is particularly significant, it is preferred to use a polymer latex in the surface protective layer or a back layer.

Descriptions of the polymer latex can be found, e.g., in *Gousei Jushi Emulsion*, compiled by Taira Okuda and Hiroshi Inagaki, Koubunshi Kankoukai (1978), *Gousei Latex no Ouyou*, compiled by Takaaki Sugimura, Yasuo Kataoka, Souichi Suzuki and Keishi Kasahara, Koubunshi Kankoukai (1993), and Souichi Muroi, *Gousei Latex no Kagaku*, Koubunshi Kankoukai (1970). Specific examples of the polymer latex include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, and latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer.

As the binder for the surface protective layer, the techniques described in JP-A-2000-267226, paragraphs [0021] to [0025], and the techniques described in JP-A-2000-19678, paragraphs [0023] to [0041] may also be used.

In the surface protective layer, a content of the polymer latex is preferably from 10 to 90 weight %, and particularly preferably from 20 to 80 weight %, based on the total binder.

The coverage (per $m^2$ of a support) of the total binder (including the water-soluble binder and the latex polymer) for each of the surface protective layer is preferably from 0.3 to 5.0 $g/m^2$, and more preferably from 0.3 to 2.0 $g/m^2$.

Temperature for the preparation of the coating solution for image-forming layer according to the invention is preferably from 30° C. to 65° C., more preferably from 35° C. to not higher than 60° C., and still more preferably from 35° C. to 55° C. It is also preferred that the coating solution for image-forming layer just after the addition of polymer latex is maintained at temperature of from 30° C. to 65° C.

The image-forming layer is provided on a support as one or more layers. When the image-forming layer is one constituent layer, it contains an organic fatty acid silver salt, light-sensitive silver halide, a reducing agent and a binder, and an additional ingredient, for example, a toning agent, a coating aid or other auxiliary agents, if desired. When the image-forming layer has two or more constituent layers, the first image-forming layer (ordinarily a layer adjacent to a support) contains an organic fatty acid silver salt and light-sensitive silver halide, and the second image-forming layer or both first and second image-forming layers contain other ingredients.

In case of a multicolor light-sensitive heat-developable photographic material, the photographic material may have the combination of two layers for each color or may contain all of the ingredients in a single layer as described in U.S. Pat. No. 4,708,928. In case of a multi-dye, multicolor light-sensitive heat-developable photographic material, each adjacent light-sensitive layer is ordinarily maintained distinctively with a functional or non-functional barrier layer provided between the light-sensitive layers as described in U.S. Pat. No. 4,469,681.

In the light-sensitive layer of the invention, various dyes and pigments (for example, C.I. Pigment Blue 60, C.I. Pigment Blue 64 or C.I. Pigment Blue 15:6) can be used from the viewpoints of improvement in color tone, prevention from the occurrence of interference fringes upon laser exposure and prevention of irradiation. Detailed descriptions thereof can be found in WO 98/36322, JP-A-10-268465 and JP-A-11-338098.

In the heat-developable photosensitive material of the invention, it is preferred to provide an anti-halation layer in the position farther from a light source compared with the light-sensitive layer.

The heat-developable photosensitive material ordinarily has a light-insensitive layer in addition to the light-sensitive layer. According to its location, the light-insensitive layer is classified into four groups, that is, (1) a protective layer provided on a light-sensitive layer (farthest from a support), (2) an interlayer provided between plural light-sensitive layers or between a light-sensitive layer and a protective layer, (3) an undercoat layer provided between a support and a light-sensitive layer and (4) a back layer provided on the side opposite to the light-sensitive layer. A filter layer is provided in the photosensitive material as a layer classified into the group (1) or (2), and an anti-halation layer is provided in the photosensitive material as a layer classified into the group (3) or (4).

Descriptions of the anti-halation layer can be found in JP-A-11-65021, paragraphs [0123] to [0124], JP-A-11-223898, JP-A-9-230531, JP-A-10-36695, JP-A-10-104779, JP-A-11-231457, JP-A-11-352625 and JP-A-11-352626.

The anti-halation layer contains an anti-halation dye having absorption at a wavelength of light exposure. Since a laser having a peak in the wavelength range of from 350 to 440 nm is used for the exposure in the invention, it is preferred to use a dye capable of absorbing light of such a wavelength in the anti-halation layer.

When the prevention of halation is carried out using a dye having absorption in the visible region, it is preferred that substantially no color of the dye is present after the image formation and, therefore, to utilize means for decoloration upon heat of heat development. In particular, it is preferred to add a thermally decoloring dye and a base precursor to a light-insensitive layer to function as an anti-halation layer. Such techniques are described in JP-A-11-231457.

An amount of the decoloring dye added can be determined depending on the use of dye. Ordinarily, the decoloring dye is used preferably in an amount for providing an optical density (absorbance) higher than 0.1, measured at the intended wavelength. The optical density is preferably from 0.15 to 2, and more preferably from 0.2 to 1. In order to attain such an optical density, the amount of dye used is ordinarily in the order of from 0.01 to 1 $g/m^2$.

By decoloring the dye in an appropriate manner, the optical density after the heat development can be reduced to 0.1 or below. Two or more decoloring dyes may be used together in a thermal decoloration type recording material or a heat-developable photosensitive material. Similarly, two or more base precursors may also be used together.

In the thermal decoloration using such a decoloring dye and a base precursor, it is preferred to use a substance capable of lowering a melting point by at least 3° C. (deg) when mixed with the base precursor, for example, the compounds as described in JP-A-11-352626 (e.g., diphenylsulfone, 4-chlorophenyl(phenyl)sulfone), or 2-naphthylbenzoate from the viewpoint of thermal decoloration capability.

For the purposes of improving the color tone of silver and preventing change of the image with a lapse of time, a coloring agent having an absorption maximum in the wavelength region of from 300 to 450 nm can be added to the photosensitive material of the invention. Such coloring agents are disclosed in JP-A-62-210458, JP-A-63-104046, JP-A-63-103235, JP-A-63-208846, JP-A-63-306436, JP-A-63-314535, JP-A-1-61745 and JP-A-2001-100363.

The coloring agent is ordinarily added in an amount of from 0.1 $mg/m^2$ to 1 $g/m^2$, and a layer to which it is added is preferably a back layer provided on the side opposite to the light-sensitive layer.

The heat-developable photosensitive material according to the invention is preferably a so-called single-sided photosensitive material, that is, a photosensitive material having at least one light-sensitive layer containing a silver halide emulsion on one side of a support and a back layer on the other side of the support.

To the photosensitive material of the invention, a matting agent is preferably added for the purpose of improving transportability. Descriptions of the matting agent can be found in JP-A-11-65021, paragraphs [0126] to [0127]. An amount of the matting agent is preferably from 1 to 400 mg, and more preferably from 5 to 300 mg, per $m^2$ of the photosensitive material.

A shape of the matting agent used in the invention may be any of regular and irregular shapes, but is preferably a regular shape, especially a spherical shape. The average diameter of particles is preferably from 0.5 to 10 μm, more preferably from 1.0 to 8.0 μm, and still more preferably from 2.0 to 6.0 μm. The variation coefficient of particle size distribution is preferably not more than 50%, more preferably not more than 40%, and still more preferably not more than 30%. The term "variation coefficient" used herein means a value represented by (standard deviation of particle diameter)/(average value of particle diameter)×100. Further, it is preferred to use two matting agents having small variation coefficients and an average diameter ratio of at least 3.

The emulsion layer surface may have any matting degree so far as it causes no stardust defect, but it has preferably Bekk smoothness of 30 to 2,000 seconds, and particularly 40 to 1,500 seconds. The Bekk smoothness can be easily determined in accordance with Japanese Industrial Standards (JIS) P8119, entitled "Paper and Paper Board Smoothness Testing Method by Bekk Smoothness Tester", and TAPPI Standard Method T479.

The matting degree of the back layer surface in the invention is preferably from 10 to 1,200 seconds, more preferably from 20 to 800 seconds, and still more preferably from 40 to 500 seconds, in terms of Bekk smoothness.

In the invention, it is preferred that the matting agent is incorporated into the outermost surface layer, a layer functioning as the outermost surface layer, or a layer close to the outer surface. It is also preferred to add the matting agent to a layer functioning as the so-called protective layer.

The back layer for use in the invention is described in JP-A-11-65021, paragraphs [0128] to [0130].

A pH on the surface of the heat-developable photosensitive material of the invention before heat-development processing is preferably not more than 7.0, and more preferably not more than 6.6. The lower limit of pH on the surface is not particularly limited, but it is approximately 3. The most preferable pH range on the surface is from 4 to 6.2.

For adjustment of the pH on the surface, an organic acid, for example, a phthalic acid derivative, a nonvolatile inorganic acid, for example, sulfuric acid, or a volatile base, for example, ammonia is used preferably from the viewpoint of decreasing the pH on the surface. In particular, ammonia is preferable for attaining a low pH value on the surface because it is easy to volatilize and can be removed at the coating step or before the heat-development.

A combination of ammonia with a nonvolatile base, for example, sodium hydroxide, potassium hydroxide or lithium hydroxide, is also preferably used. A method of measuring the pH on the surface is described in JP-A-2000-284399, paragraph [0123].

A hardener may be used in each constituent layer, for example, a light-sensitive layer, a protective layer or a back layer. The hardeners and hardening methods are described in T. H. James, *THE THEORY OF THE PHOTOGRAPHIC PROCESS FOURTH EDITION*, pages 77 to 87, Macmillan Publishing Co., Inc. (1977). Preferred examples the hardner include chrome alum, sodium salt of 2,4-dichloro-6-hydroxy-s-triazine, N,N-ethylenebis(vinylsulfonacetamide), N,N-propylenebis(vinylsulfonacetamide), the polyvalent metal ions as described in the above-cited book, page 78, the polyisocyanates as described in U.S. Pat. No. 4,281,060 and JP-A-6-208193, the epoxy compounds as described in U.S. Pat. No. 4,791,042, and the vinylsulfone compounds as disclosed in JP-A-62-89048.

The hardener is ordinarily added as a solution. A period of addition of the hardener solution to a coating solution for protective layer is from 180 minutes before the coating to just before the coating, and preferably from 60 minutes to 10 seconds before the coating. There are no particular restrictions on the method and the condition for mixing the hardener solution with the coating solution so far as the effects of the invention can be sufficiently achieved.

As specific mixing methods, there are known a mixing method using a tank controlled so that the average stay time calculated from the rate of liquid flow added to the tank and the volume of the liquid sent into a coater becomes the desired value, and a method of using a static mixer as described in N. Harnby, M. F. Edwards and A. W. Nienow, *Ekitai Kongou Gijutsu*, Chapter 8 (translated by Koji Takahashi), The Nikkan Kogyo Shimbun, Ltd. (1989).

Surfactants for use in the invention include those described in JP-A-11-65021, paragraph [0132], solvents for use in the invention include those described in ibid., paragraph [0133], supports for use in the invention include those described in ibid., paragraph [0134], anti-static or conductive layers for use the invention include those described in ibid., paragraph [0135], color image formation methods for use the invention include those described in ibid., paragraph [0136], and lubricants for use in the invention include those described in JP-A-11-84573, paragraphs [0061] to [0064] and JP-A-2001-83679, paragraphs [0049] to [0062].

It is preferred for the photosensitive material of the invention to have a conductive layer containing a metal oxide. As a conductive material contained in the conductive layer, a metal oxide in which oxygen defect or foreign metal atom is introduced and thereby increasing conductivity is preferably used.

Preferable examples of the metal oxide include ZnO, $TiO_2$ and $SnO_2$. The addition of Al or In to ZnO, that of Sb, Nb, P or halogen element to $SnO_2$, and that of Nb or Ta to $TiO_2$ are preferred. In particular, $SnO_2$ to which Sb is added is preferably used.

The amount of foreign atom added is preferably from 0.01 to 30 mole %, and more preferably from 0.1 to 10 mole %. The metal oxide may have any of spherical, acicular and tabular shapes. From the viewpoint of effectiveness for imparting conductivity, acicular grain having a major axis/minor axis ratio of not less than 2.0, and preferably from 3.0 to 50, is advantageously used.

The amount of metal oxide used is preferably from 1 to 1,000 mg/$m^2$, more preferably from 10 to 500 mg/$m^2$, and still more preferably from 20 to 200 mg/$m^2$. The conductive layer may be positioned on the emulsion layer side or the back layer side, but it is preferably provided between a support and a back layer. Specific examples of the conductive layer for use in the invention are described in JP-A-7-295146 and JP-A-11-223901.

In the invention, it is preferable to use a fluorine-containing surfactant. Specific examples of the fluorine-containing surfactant include the compounds described in JP-A-10-197985, JP-A-2000-19680 and JP-A-2000-214554. The fluorine-containing polymer surfactants described in JP-A-

9-281636 are also preferably used. The fluorine-containing surfactants described in JP-A-2002-82411 are particularly preferably used in the invention.

The support for use in the heat-developable photosensitive material of the invention is preferably a transparent support. The transparent support preferably used in the invention is polyester, particularly polyethylene terephthalate, which has been subjected heat treatment in a temperature range of 130 to 185° C. for the purposes of lessening internal strains upon biaxial stretch remaining in the film and preventing the distortion caused by thermal shrinkage during the heat-development. In the case of a heat-developable photosensitive material for medical use, the transparent support may be colored with a blue dye (e.g., Dye-1 described in Example of JP-A-8-240877), or it may be colorless.

To the support, an undercoat technique, for example, using the water-soluble polyester as described in JP-A-11-84574, the styrene-butadiene copolymer as described in JP-A-10-186565 or the vinylidene chloride copolymers as described in JP-A-2000-39684 and JP-A-2001-83679, paragraphs [0063] to [0080] is preferably applied.

To the anti-static layer and the undercoat layer, the techniques as described in JP-A-56-143430, JP-A-56-143431, JP-A-58-62646, JP-A-56-120519, JP-A-11-84573, paragraphs [0040] to [0051], U.S. Pat. No. 5,575,957, and JP-A-11-223898, paragraphs [0078] to [0084] can also be applied.

including extrusion coating, slide coating, curtain coating, dip coating, knife coating, flow coating and the extrusion coating using a hopper as described in U.S. Pat. No. 2,681,294 can be used. Further, the extrusion coating and slide coating techniques as described in Stephen F. Kistler and Petert M. Schweizer, *LIQUID FILM COATING*, pages 399-536, CHAPMAN & HALL CO. (1997) are preferably employed. The slide coating technique is particularly preferably used. Examples of the shape of a slide coater used in the slide coating operation are illustrated in the book cited above, FIG. 11b.1 on page 427. Moreover, if desired, simultaneous coating of two or more layers may be performed in accordance with the methods as described in the book cited above, pages 399-536, U.S. Pat. No. 2,761,791 and British Patent 837,095.

A coating solution for organic fatty acid silver salt-containing layer for use in the invention is preferably a so-called thixotropic fluid. For the technique of thixotropic fluid, JP-A-11-52509 can be referred to.

The coating solution for organic fatty acid silver salt-containing layer has preferably a viscosity of from 400 to 100,000 mPa·s, and more preferably from 500 to 20,000 mPa·s, at a shear rate of 0.1 $S^{-1}$. The viscosity of the coating solution at a shear rate of 1,000 $S^{-1}$ is preferably from 1 to 200 mPa·s, and more preferably from 5 to 80 mPa·s.

To the heat-developable photosensitive material of the invention can also be applied the techniques described in

| | | | |
|---|---|---|---|
| EP-A-803,764, | EP-A-883,022, | WO 98/36322, | JP-A-56-62648, |
| JP-A-58-62644, | JP-A-9-43766, | JP-A-9-281637, | JP-A-9-297367, |
| JP-A-9-304869, | JP-A-9-311405, | JP-A-9-329865, | JP-A-10-10669, |
| JP-A-10-62899, | JP-A-10-69023, | JP-A-10-186568, | JP-A-10-90823, |
| JP-A-10-171063, | JP-A-10-186565, | | JP-A-10-186567, |
| JP-A-10-186569 to | JP-A-10-186572, | | JP-A-10-197974, |
| JP-A-10-197982, | JP-A-10-197983, | | JP-A-10-197985 to |
| JP-A-10-197987, | JP-A-10-207001, | | JP-A-10-207004, |
| JP-A-10-221807, | JP-A-10-282601, | | JP-A-10-288823, |
| JP-A-10-288824, | JP-A-10-307365, | | JP-A-10-312038, |
| JP-A-10-339934, | JP-A-11-7100, | JP-A-11-15105, | JP-A-11-24200, |
| JP-A-11-24201, | JP-A-11-30832, | JP-A-11-84574, | JP-A-11-65021, |
| JP-A-11-109547, | JP-A-11-125880, | | JP-A-11-129629, |
| JP-A-11-133536 to | JP-A-11-133539, | | JP-A-11-133542, |
| JP-A-11-133543, | JP-A-11-223898, | | JP-A-11-352627, |
| JP-A-11-305377, | JP-A-11-305378, | | JP-A-11-305384, |
| JP-A-11-305380, | JP-A-11-316435, | | JP-A-11-327076, |
| JP-A-11-338096, | JP-A-11-338098, | | JP-A-11-338099, |
| JP-A-11-343420, | JP-A-2000-187298, | | JP-A-2000-10229, |
| JP-A-2000-47345, | JP-A-2000-206642, | | JP-A-2000-98530, |
| JP-A-2000-98531, | JP-A-2000-112059, | | JP-A-2000-112060, |
| JP-A-2000-112104, | JP-A-2000-112064 and | | JP-A-2000-171936. |

The heat-developable photosensitive material is preferably a mono-sheet type (or a type which forms images on the heat-developable photosensitive material without using another sheet such as an image-receiving material).

Into the heat-developable photosensitive material may further be incorporated an antioxidant, a stabilizer, a plasticizer, an ultraviolet absorbent and a coating aid. These additives are added to any of light-sensitive layer and light-insensitive layer. For details of the additives WO 98/36322, EP-A-803,764, JP-A-10-186567 and JP-A-10-186568 can be referred to.

In the preparation of heat-developable photosensitive material of the invention, any coating method may be employed. Specifically, a wide variety of coating methods For the purpose of controlling fluctuations in photographic performances during preservation of the photosensitive material of the invention after the preparation, or improving the resistance of the photosensitive material to curl or core set, it is preferred to package the photosensitive material with a packaging material having a low oxygen-permeability and/or a low moisture-permeability.

The oxygen-permeability of the wrapping material is preferably not more than $57\times10^{-6}$ ml/Pa·m$^2$·s (50 ml/atm·m$^2$·day), more preferably not more than $11.4\times10^{-6}$ ml/Pa·m$^2$·s (10 ml/atm·m$^2$·day), and still more preferably not more than $1.14\times10^{-6}$ ml/Pa·m$^2$·s (1.0 ml/atm·m$^2$·day), measured at 25° C. The moisture-permeability is preferably not more than $11.4\times10^{-6}$ g/Pa·m$^2$·s (10 g/atm·m$^2$·day), more preferably not more than $7.2\times10^{-6}$ g/Pa·m$^2$·s (5 g/atm·m$^2$·day), and still more preferably not more than $1.14\times10^{-6}$ g/Pa·m$^2$·s (1 g/atm·m$^2$·day).

Examples of the packaging material having such low oxygen-and/or moisture-permeability include the packaging materials described in JP-A-8-254793 and JP-A-2000-206653.

It is preferred that the heat-developable photosensitive material of the invention is subjected to development processing by a heat-developing machine having an exposure section, a heat-development section and a cooling section. The heat-developable photosensitive material is exposed imagewise, for example, by a laser in the exposure section, conveyed in the heat-development section and heat-developed. Then, it is sufficiently cooled in the cooling section and discharged out of the heat-developing machine. According to a preferred method of forming an image of the invention, the heat-developable photosensitive material is processed by a heat-developing machine having an exposure section, a heat-development section and a cooling section, in which a ratio of a zone length of the cooling section to a zone length of the heat-development section is satisfied the following formula:

Zone length of the cooling section/Zone length-of the heat-development section $\leqq 3.5$ In the above formula, the zone length of the heat-development section represents a length of conveying path wherein the heat-developable photosensitive material is heated at a developing temperature in the heat-developing machine. The zone length of the cooling section represents a length of path after the heat-development section until the heat-developable photosensitive material is discharged from a light-tight area of the heat-developing machine to a place under room light where the heat-developing machine is set up. To shorten the zone length of the cooling section so as to realize the above ratio of not more than 3.5 makes it possible to provide a heat-developing machine having a compact size and a high processing speed. However, such a heat-developing machine brings about the occurrence of fog because a heat-developable photosensitive material is discharged to a place under room light without sufficient cooling of the heat-developable photosensitive material. In conventional heat-developable photosensitive materials, since silver halides therein are not fixed, fog nuclei are newly formed when they are exposed to room light, and further, in case of the high temperature condition, the fog nuclei growth to fog by a reaction subsequent to the development. On the contrary, a method of forming an image, which is sufficiently prevented from the occurrence of fog, can be provided by using the specific heat-developable photosensitive material exhibiting substantially no sensitivity after heat-development according to the invention.

The ratio of zone length of the cooling section to zone length of the heat-development section is preferably not more than 2.9, more preferably not more than 2.0, and particularly preferably not more than 1.5.

A cooling time after the heat-developable photosensitive material having come out the heat-development section until being discharged out of the machine can be appropriately determined, and is preferably not longer than 35 seconds, more preferably not longer than 25 seconds, still more preferably from 5 to 20 seconds, and particularly preferably from 5 to 15 seconds. In such a short period of cooling time, images are preferably formed by using the heat-developable photosensitive material according to the present invention.

A length of path where the heat-developable photosensitive material passes through after having come out the heat-development section until being discharged out of the machine can also be appropriately determined, and is preferably from 1 to 70 cm, more preferably from 5 to 60 cm, and still preferably from 5 to 50 cm.

The heat-developable photosensitive material of the invention may be developed by any method, but it is ordinarily developed by temperature rise after the imagewise exposure. The temperature for development is preferably from 80° C. to 250° C., more preferably from 100° C. to 140° C., and still more preferably from 110° C. to 130° C. The development time is preferably from 1 to 60 seconds, more preferably from 3 to 30 seconds, still more preferably from 5 to 25 seconds, and particularly preferably from 7 to 15 seconds.

The heat-development may be performed in a way of using a drum heater or a plate heater, but the way of using a plate heater is preferred in the invention. To the heat-development using a plate heater, it is preferable to apply the method described in JP-A-11-133572. More specifically, the method using a heat-development apparatus that enables conversion of latent images formed in the heat-developable photosensitive material into visible images by bringing the photosensitive materials into contact with heating means installed in the heat-development section. The apparatus is characterized in that the heating means installed therein is a plate heater, a plurality of pressing rollers are opposed along one surface of the plate heater and the heat-developable photosensitive material is made to pass between the plate heater and the pressing rollers, thereby effecting the heat-development. It is preferable that the plate heater is two- to six-segmented and the temperature of end segment is reduced by the order of 1 to 10° C.

For instance, a case can be used where a quartet of plate heaters capable of independent temperature control is used and these plate heaters are adjusted to temperatures of 112° C., 119° C., 121° C. and 120° C., respectively. Such away of heating is described in JP-A-54-30032, and can remove the moisture and the organic solvent contained in the heat-developable photosensitive material into the outside of the photosensitive material and moreover control a support shape change caused by an abrupt heating of the heat-developable photosensitive material.

The photosensitive material of the invention can fully exhibit its characteristics in the case of short exposure to light of high light intensity not lower than 1 mW/mm$^2$. When the exposure is performed at such high light intensity, the heat-developable material containing the high silver iodide content silver halide emulsion of the invention and light-insensitive organic fatty acid silver salt can attain sufficient sensitivity. In other words, the exposure to light of high light intensity can provide high sensitivity in the invention, compared with exposure to light of low light intensity.

The light intensity is preferably from 2 mW/mm$^2$ to 50 W/mm$^2$, and more preferably from 10 mW/mm$^2$ to 50 W/mm$^2$.

Any light source may be used as far as it has light intensity in the above-described range, but a laser beam is preferably used.

Examples of the laser beam preferably used in the invention include a gas laser ($Ar^+$, Kr), a YAG laser, a dye laser and a laser diode. A combination of laser and a second harmonic device can also be used. A laser diode emitting blue to violet light is more preferred. As an example of high-power, blue to violet light-emitting laser diode, a laser diode NLHV3000E produced by NICHIA CORPORATION can be exemplified. For example, a laser emitting light having a wavelength of 405 nm and a power of 35 mW is available.

By using such a laser, the high light intensity light in a wavelength range of from 390 to 430 nm, which is particularly preferable for the invention, can be obtained.

As a medical laser imager provided with an exposure section and a heat-development section, Fuji Medical Dry Laser Imager FM-DP L can be used.

The model FM-DP L is described in *Fuji Medical Review*, No. 8, pages 39 to 55. The techniques described therein are applied to a laser imager used for the heat-developable photosensitive material of the invention. Further, the heat-developable photosensitive material of the invention can also be utilized as a heat-developable photosensitive material for the laser imager in "AD Network", which Fuji Medical System offers as a network system compliant with the DICOM standard.

Figure 4:
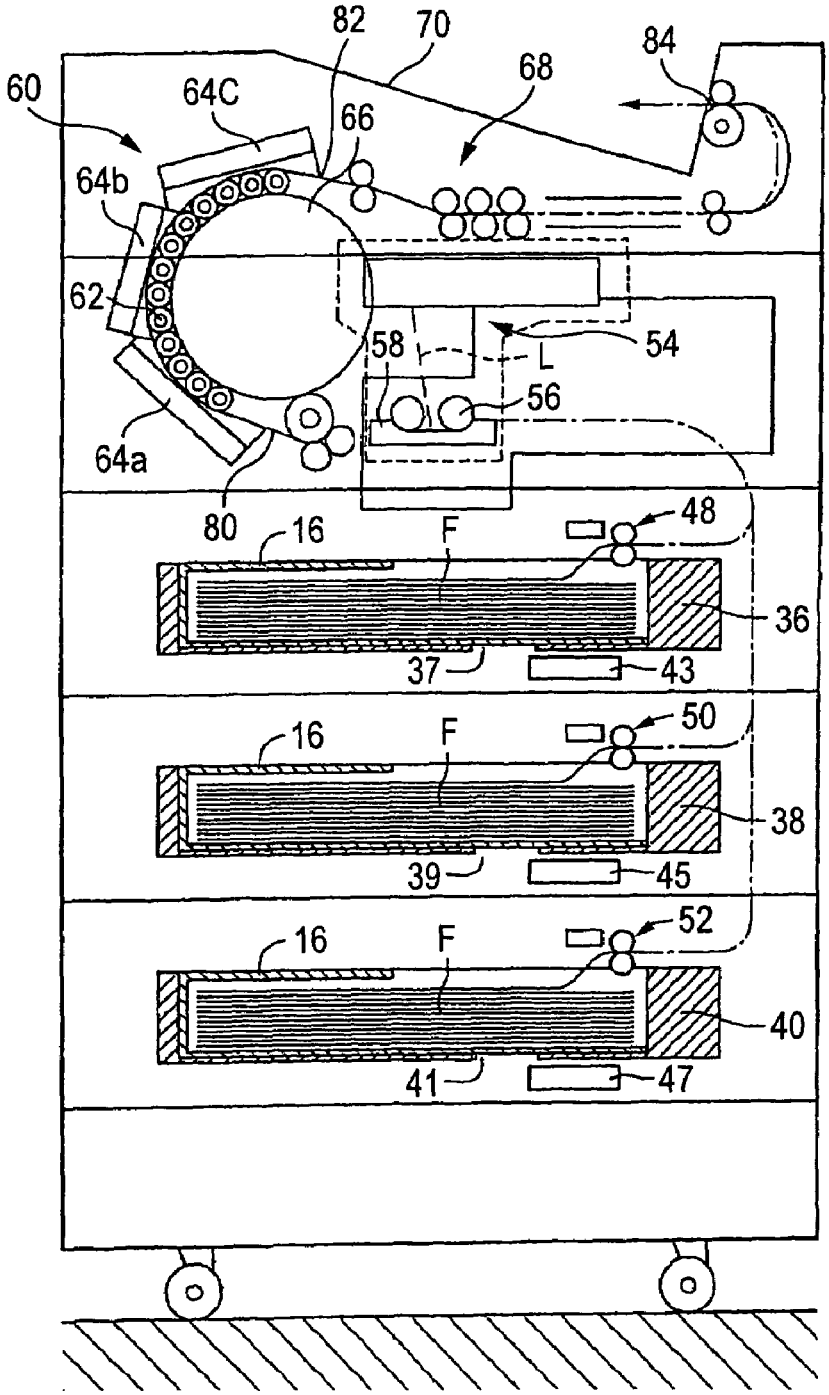
FIG. 4 is a schematic view showing a heat-developing machine, which can be preferably used in accordance with the invention.

A heat-developing machine, which can be preferably used in accordance with the invention, is shown in FIG. 4. However, the heat-developing machine should not be construed as being limited thereto. In FIG. 4, a stack of heat-developable photosensitive materials F partially surrounded with a protective carrier 16 is placed in each of trays 36, 38 and 40. The trays have apertures 37, 39 and 41 for reading bar cord so as to face bar cord readers 43, 45 and 47, respectively. The heat-developable photosensitive material F is fed by a sheet feeding mechanism 48, 50 or 52, and conveyed to an exposure section 54 above the trays. An image-recording apparatus installed in the exposure section irradiates the heat-developable photosensitive material F with a laser beam L modulated based on an image information to record the image information as latent images. In the exposure section 54, the heat-developable photosensitive material F is conveyed while it is pressed to a plate 58 by means of a roller 56. In succession to the exposure section, a heat-development section 60 is allocated, in which the heat-developable photosensitive material F is heated so that the latent images thereon are converted to visible images. In the heat-development section, multiple rollers 62 for conveying the heat-developable photosensitive material F, plate heaters 64*a*, 64*b* and 64*c* for heating the heat-developable photosensitive material F being conveyed along a curve formed by the multiple rollers 62, and a drum 66 for driving to rotate the multiple rollers 62 are disposed. The term "zone length of the heat-development section" here means the total length of plate heaters 64*a*, 64*b* and 64*c*, and the start of heat-development section 80 and the end of heat-development section 82 are indicated in FIG. 4, respectively. Following to the heat-development section, a cooling section 68 for cooling the heat-developable photosensitive material F is arranged. As cooling means, it is preferred, for example, that a gradual cooling part of a brush roller and a rapid cooling part contacting the heat-developable photosensitive material F with a metallic material are arranged. The heat-development section and the cooling section are covered in order for light shielding by means of a cover 70. The term "zone length of the cooling section" here means a length of path after the heat-development section until the heat-developable photosensitive material is discharged under room light, and specifically a distance from the end of heat-development section 82 to the end of cooling section 84. The ratio of zone length of the cooling section to zone length of the heat-development section is 1.5 in the heat-developing machine shown in FIG. 4.

The heat-developable photosensitive material of the invention forms black-and-white images based on silver images, and preferably used as a heat-developable photosensitive material for medical diagnosis, a heat-developable photosensitive material for industrial photography, a heat-developable photosensitive material for lithography and a heat-developable photosensitive material for COM purpose.

The invention will be described in more detail with reference to the following examples, but the invention should not be construed as being limited thereto.

EXAMPLE 1

(Production of PET Support)

<Stretch of PET Film>

PET having intrinsic viscosity (IV) of 0.66 (measured in a mixture of phenol and tetrachloroethane (6:4 by weight) at 25° C.) was produced using terephthalic acid and ethylene glycol in a conventional manner. The PET was pelletized, dried at 130° C. for 4 hours, and then molten at 300° C. Into the molten PET, 0.04 wt % of Dye BB having the structure shown below was incorporated. Thereafter, it was extruded from a T die and quenched, thereby forming a unstretched film having a thickness so as to make a thickness of 175 μm after thermal setting.

Dye BB

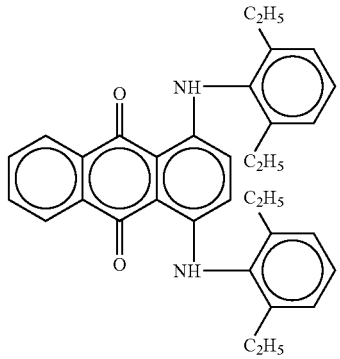

The film was stretched 3.3 times in the direction of length by means of rollers having different circumferential speeds, and then stretched 4.5 times in the direction of width by means of tenter. The temperatures during the stretching operations were 110° C. and 130° C., respectively. The film was then thermally set at 240° C. for 20 seconds and relaxed 4% in the direction of width at the same temperature. Thereafter, the part corresponding to tenter's chuck was slit off, and the both sides thereof were subjected to knurl processing. The film was rolled up under a tension of 4 kg/cm$^2$ to form a roll of film having a thickness of 175 μm.

<Surface Corona Treatment>

Both surfaces of the support was treated at a rate of 20 m/min at room temperature by means of a solid-state corona treater, Model 6 KVA produced by Pillar Technologies. From the readout values of current and voltage during the treatment, it was found that the support was subjected to the treatment at 0.375 kV·A·min/m$^2$. The treatment frequency was 9.6 kHz and the gap clearance between an electrode and a dielectric roll at the treatment was and 1.6 mm.

(Production of Support with Undercoat Layer)

<Preparation of Coating Solution for Undercoat Layer>

Formula (1) (for Undercoat Layer on Photosensitive Layer Side)

| | |
|---|---|
| Pesresin A-520 produced by Takamatsu Oil & Fat Co., Ltd. (30 wt % solution) | 59 g |
| Polyethylene glycol monononyl phenyl ether (average number of ethylene oxide units = 8.5, 10 wt % solution) | 5.4 g |
| MP-1000, produced by Soken Chemical & Engineering Co., Ltd. (polymer fine particles having an average particle size of 0.4 μm) | 0.91 g |
| Distilled water | 935 ml |
| Formula (2) (for first layer on back side) | |
| Styrene-butadiene copolymer latex (solid Content = 40 wt %, weight ratio of styrene/butadiene = 68/32) | 158 g |
| Sodium salt of 2,4-dichloro-6-hydroxy-s-triazine (8 wt % aqueous solution) | 20 g |
| Sodium laurylbenzenesulfonate (1 wt % aqueous solution) | 10 ml |
| Distilled water | 854 ml |
| Formula (3) (for second layer on back side) | |
| $SnO_2$/SbO (9/1 by weight, average grain size 0.038 μm, 17 wt % dispersion) | 84 g |
| Gelatin (10 wt % aqueous solution) | 89.2 g |
| Metolose TC-5 produced by Shin-Etsu Chemical Co., Ltd. (2 wt % aqueous solution) | 8.6 g |
| MP-1000 produced by Soken Chemical & Engineering Co., Ltd. | 0.01 g |
| Sodium dodecylbenzenesulfonate (1 wt % aqueous solution) | 10 ml |
| NaOH (1 wt % aqueous solution) | 6 ml |
| Proxel (produced by ICI) | 1 ml |
| Distilled water | 805 ml |

<Application of Coating Solution for Undercoat Layer>

The biaxially stretched polyethylene terephthalate support having a thickness of 175 μm subjected to the corona discharge treatment described above was coated on one side (photosensitive layer side) with the coating solution for undercoat layer of formula (1) at a wet coverage of 6.6 ml/m$^2$ (perside) by means of a wire bar and dried at 180° C. for 5 minutes. Subsequently, the support was coated on the other side (back side) with the coating solution for undercoat layer of formula (2) at a wet coverage of 5.7 ml/m$^2$ by means of a wire bar and dried at 180° C. for 5 minutes, and further thereon with the coating solution for undercoat layer of formula (3) at a wet coverage of 7.7 ml/m$^2$ by means of a wire bar and dried at 180° C. for 6 minutes. Thus, the support provided with the undercoat layers was produced.

(Preparation of Coating Solution on Back Side)

<Preparation of Coating Solution for Anti-Halation Layer>

A coating solution for anti-halation layer was prepared by mixing 17 g of gelatin, 9.6 g of polyacrylamide, 1.5 g of monodispersed fine particles of polymethyl methacrylate (average particle size: 8 μm, standard deviation of particle diameter: 0.4), 0.03 g of benzisothiazolinone, 2.2 g of sodium polystyrenesulfonate, 0.1 g of Blue Dye Compound-1, 0.1 g of Yellow Dye Compound-1 and 844 ml of water.

<Preparation of Coating Solution for Protective Layer on Back Side>

A coating solution for protective layer on the back side was prepared by mixing 50 g of gelatin, 0.2 g of sodium polystyrenesulfonate, 2.4 g of N,N-ethylenebis(vinylsulfonacetamide), 1 g of sodium tert-octylphenoxyethoxyethanesulfonate, 30 mg of benzisothiazolinone, 37 mg of a fluorine-containing surfactant (F-1: potassium salt of N-perfluorooctylsulfonyl-N-propylalanine), 150 mg of a fluorine-containing surfactant (F-2: polyethylene glycol mono(N-perfluorooctylsulfonyl-N-propyl-2-aminoethyl) ether [average polymerization degree of ethylene oxide: 15]), 64 mg of a fluorine-containing surfactant (F-3), 32 mg of a fluorine-containing surfactant (F-4), 10 mg of a fluorine-containing surfactant (F-7), 5 mg of a fluorine-containing surfactant (F-8), 8.8 g of acrylic acid/ethyl acrylate copolymer (copolymerization ratio: 5/95 by weight), 0.6 g of Aerosol-OT (produced by American Cyanamid Co.), a liquid paraffin emulsion containing 1.8 g of liquid paraffin and 950 ml of water in a vessel kept at 40° C.

(Preparation of Silver Halide Emulsion)

<Preparation of Silver Halide Emulsion 1>

A solution prepared by adding to 1420 ml of distilled water, 4.3 ml of a 1 wt % potassium iodide solution, 3.5 ml of diluted sulfuric acid having a concentration of 0.5 mole/L and 36.7 g of phthalated gelatin was kept at 42° C. with stirring in a reaction pot made of stainless steel. Solution A prepared by diluting 22.22 g of silver nitrate to 195.6 ml with distilled water and Solution B prepared by diluting 21.8 g of potassium iodide to 218 ml with distilled water were added thereto at constant flow rates over a period of 9 minutes. Thereafter, 10 ml of a 3.5 wt % aqueous solution of hydrogen peroxide and then, 10.8 ml of a 10 wt % aqueous solution of benzimidazole were added thereto.

Furthermore, Solution C prepared by diluting 51.86 g of silver nitrate to 317.5 ml with distilled water and Solution D prepared by diluting 60 g of potassium iodide to 600 ml with distilled water were added in such a manner that Solution C was added at a constant flow rate over a period of 120 minutes and Solution D was added in accordance with a controlled double jet method while keeping pAg of the mixture at 8.1. The pH of the mixture was adjusted to 3.8 using diluted sulfuric acid having a concentration of 0.5 mole/L, the stirring was terminated, and the mixture was subjected to precipitation, desalting and water washing steps. The pH was adjustment to 5.9 using an aqueous solution of sodium hydroxide having a concentration of 1 mole/L. Thus, a silver halide dispersion having pAg of 8.0 was prepared.

The silver halide dispersion was kept at 38° C. with stirring, 5 ml of a 0.34 wt % methanol solution of 1,2-benzisothiazolin-3-one was added thereto, and then the temperature of the dispersion was raised to 47° C. Twenty minutes after the temperature raise, a methanol solution of sodium benzenethiosulfonate was added thereto in an amount of $7.6\times10^{-5}$ mole/mole of silver, and further after 5 minutes, a methanol solution of Tellurium Sensitizer C was added thereto in an amount of $2.9\times10^{-4}$ mole per mole of silver, followed by ripening for 91 minutes.

To the ripened dispersion was added 1.3 ml of a 0.8 wt % methanol solution of N,N'-dihydroxy-N"-diethylmelamine. After 4 minutes, were added a methanol solution of 5-methyl-2-mercaptobenzimidazole in an amount of $4.8\times10^{-3}$ mole per mole of silver and a methanol solution of 1-phenyl-2-heptyl-5-mercapto-1,3,4-triazole in an amount of $5.4\times10^{-3}$ mole per mole of silver. Thus, Silver Halide Emulsion 1 was prepared.

The grains in the silver halide emulsion thus-prepared were pure silver iodide grains having an average sphere equivalent diameter of 0.040 μm and a variation coefficient of 18% with respect to sphere equivalent diameter. The values concerning grain size were determined by observation of 1,000 grains using an electron microscope and calculation of the average.

<Preparation of Silver Halide Emulsion 2>

A solution prepared by adding to 1421 ml of distilled water, 5 ml of a 1 wt % potassium bromide solution, 3.5 ml of diluted sulfuric acid having a concentration of 0.5 mole/L and 40 g of phthalated gelatin was kept at 25° C. with stirring in a reaction pot made of stainless steel. Solution A prepared by diluting 22.22 g of silver nitrate to 95.4 ml with distilled water and Solution B prepared by diluting 15.9 g of potassium bromide to 97.4 ml with distilled water were added thereto at constant flow rates over a period of 60 seconds. Thereafter, 10 ml of a 3.5 wt % aqueous solution of hydrogen peroxide and then, 10.8 ml of a 10 wt % aqueous solution of benzimidazole were added thereto. Furthermore, Solution C prepared by diluting 51.86 g of silver nitrate to 317.5 ml with distilled water and Solution D prepared by diluting 45.8 g of potassium bromide to 400 ml with distilled water were added in such a manner that Solution C was added at a constant flow rate over a period of 20 minutes and Solution D was added in accordance with a controlled double jet method while keeping pAg of the mixture at 8.1. Ten minutes after the start of the addition of Solutions C and D, potassium hexachloroiridate (III) was added in an amount of $1\times10^{-4}$ mole per mole of silver. The pH of the mixture was adjusted to 3.8 using diluted sulfuric acid having a concentration of 0.5 mole/L, the stirring was terminated, and the mixture was subjected to precipitation, desalting and water washing steps. The pH was adjustment to 5.9 using an aqueous solution of sodium hydroxide having a concentration of 1 mole/L. Thus, a silver halide dispersion having pAg of 8.0 was prepared.

The silver halide dispersion was kept at 38° C. with stirring, 5 ml of a 0.34 wt % methanol solution of 1,2-benzisothiazolin-3-one was added thereto, and after 40 minutes the temperature of the dispersion was raised to 47° C. Twenty minutes after the temperature raise, a methanol solution of sodium benzenethiosulfonate was added thereto in an amount of $7.6\times10^{-5}$ mole/mole of silver, and further after 5 minutes, a methanol solution of Tellurium Sensitizer C was added thereto in an amount of $1.1\times10^{-4}$ mole per mole of silver, followed by ripening for 91 minutes. Then, 1.3 ml of a 0.8 wt % methanol solution of N,N'-dihydroxy-N"-diethylmelamine was added thereto, and further after 4 minutes, were added a methanol solution of 5-methyl-2-mercaptobenzimidazole in an amount of $4.8\times10^{-3}$ mole per mole of silver, a methanol solution of 1-phenyl-2-heptyl-5-mercapto-1,3,4-triazole in an amount of $3.3\times10^{-3}$ mole per mole of silver and an aqueous solution of 1-(3-methylureidophenyl)-5-mercaptotetrazole in an amount of $4.7\times10^{-3}$ mole per mole of silver. Thus, Silver Halide Emulsion 2 was prepared.

The grains in the silver halide emulsion thus-prepared were cubic pure silver bromide grains having an average sphere equivalent diameter of 0.040 μm and a variation coefficient of 20% with respect to sphere equivalent diameter.

<Preparation of Emulsion A for Coating Solution>

Silver Halide Emulsion 1 was dissolved, and was added thereto a 1 wt % aqueous solution of benzothiazolium iodide in an amount of $7\times10^{-3}$ mole/mole of silver. Further, water was added thereto in an amount so as to make the content of silver halide 38.2 g per kg of the mixed emulsion for coating solution.

<Preparation of Emulsion B for Coating Solution>

Emulsion B for Coating Solution was prepared in the same manner as in Preparation of Emulsion A for Coating Solution except for using Silver Halide Emulsion 2 in place of Silver Halide Emulsion 1.

(Preparation of Dispersion of Fatty Acid Silver Salt)

<Preparation of Fatty Acid Silver Salt Dispersion 1>

A mixture of 87.6 kg of behenic acid (Edenor C22-85R, trade name, a product of Henkel Co.), 423 liters of distilled water, 49.2 liters of an aqueous solution of sodium hydroxide having a concentration of 5 mole/Land 120 liters of tert-butanol was reacted with stirring for one hour at 75° C. to prepare a sodium behenate solution. Separately, 206.2 liters of an aqueous solution (pH 4.0) containing 40.4 kg of silver nitrate was prepared and kept at 10° C. A reaction vessel containing 635 liters of distilled water and 30 liters of tert-butanol was kept at 30° C. with thoroughly stirring, and thereto were added the total amount of the above-described sodium behenate solution and the total amount of the above-described silver nitrate solution at the individual constant flow rates over a period of 93 minutes and 15 seconds and a period of 90 minutes, respectively.

More specifically, only the aqueous solution of silver nitrate was added for a period of 11 minutes from the beginning of addition, then the sodium behenate solution began to be added, and only the addition of the sodium behenate solution was added for a period of 14 minutes and 15 seconds after completing the addition of the aqueous silver nitrate solution. During the addition, the temperature inside the reaction vessel was maintained at 30° C. by controlling externally so that the solution temperature was kept constant.

A double-pipe for adding the sodium behenate solution was kept warm by circulating hot water through the outer part thereof so that the solution temperature at the exit of the addition nozzle tip was regulated at 75° C. As to a double-pipe for adding the aqueous silver nitrate solution, the solution temperature was kept constant by circulating cold water through the outer part of the pipe. The position for addition of the sodium behenate solution and that for addition of the aqueous silver nitrate solution were arranged symmetrically with respect to the stirring axis above the reaction solution so as to avoid contact of the nozzle tips with the reaction solution.

After the addition of the sodium behenate solution was completed, the reaction solution was stirred for 20 minutes at the same temperature, and then the solution temperature was raised to 35° C. over a period of 30 minutes, followed by ripening for 210 minutes. Immediately after the completion of the ripening, the solid matter was collected by centrifugal filtration and washed with water until the filtrated water showed a conductivity of 30 μS/cm. Thus, the fatty acid silver salt was obtained. The solid matter obtained was stored as a wet cake without drying.

The shape of the silver behenate grains thus-obtained was evaluated by electron micrography. As a result, it was found that the grains were scaly crystals with the average a value of 0.14 μm, the average b value of 0.4 μm, the average c value of 0.6 μm, the average aspect ratio of 5.2, the average sphere equivalent diameter of 0.52 μm and the variation coefficient of 15% with respect to the sphere equivalent diameters (wherein a, b and c have the same meanings as defined hereinbefore).

To the wet cake in an amount corresponding to 260 kg on a dry solid basis, 19.3 kg of polyvinyl alcohol (PVA-217, trade name, a product of Kuraray Co. Ltd.) was added, and then water was added thereto in the amount to adjust the total weight of the resultant mixture to 1,000 kg. The mixture was made into slurry with a dissolver blade and further preliminary dispersed with a pipeline mixer (Model PM-10 produced by Mizuho Industrial Co., Ltd.)

The preliminarily dispersed solution was processed three times using a dispersing machine (Microfluidizer M-610, trade name, a product of Microfluidex International Corporation, wherein Z-type interaction chamber was used), under the pressure adjusted to 1,260 kg/cm$^2$, thereby preparing a dispersion of silver behenate. The dispersion temperature was set at 18° C. by mounting coiled heat exchangers on the front and rear of the interaction chamber respectively for controlling the temperature of coolant used therein.

A specific surface area of the silver behenate obtained by electron microscopic observation was 25.

<Preparation of Fatty Acid Silver Salt Dispersions 2 to 4>

Fatty Acid Silver Salt Dispersion 2 was prepared in the same manner as in Preparation of Fatty Acid Silver Salt Dispersion 1 except that the temperature inside the reaction vessel was changed from 30° C. to 28° C., the period for adding only the aqueous solution of silver nitrate was changed from 11 minutes to 12 minutes, and the pressure of dispersing machine for dispersing the preliminarily dispersed solution was changed from 1,260 kg/cm$^2$ to 1,100 kg/cm$^2$. Similarly, Fatty Acid Silver Salt Dispersions 3 and 4 were prepared under the conditions described in Table 1 below, respectively.

TABLE 1

| Fatty Acid Silver Salt Dispersion | Temperature of Reaction Vessel (° C.) | Period for Adding Only Silver Nitrate (minute) | Pressure at Dispersion (kg/cm$^2$) | Specific Surface Area |
|---|---|---|---|---|
| 1 | 30 | 11.0 | 1,260 | 25 |
| 2 | 28 | 12.0 | 1,100 | 21 |
| 3 | 25 | 20.0 | 1,000 | 16 |
| 4 | 20 | 20.0 | 800 | 7 |

(Preparation of Dispersion of Reducing Agent)

<Preparation of Dispersion of Reducing Agent-2>

To a mixture of 10 kg of Reducing Agent-2 (6,6'-di-tert-butyl-4,4'-dimethyl-2,2'-butylidenedipehnol) and 16 kg of a 10 wt % aqueous solution of modified polyvinyl alcohol (Poval MP 203 produced by Kuraray Co., Ltd.) was added 10 kg of water, and the mixture was thoroughly admixed, thereby preparing a slurry.

The slurry was fed by means of a diaphragm pump into a horizontal sand mill (Model UVM-2 produced by AIMEX Co., Ltd.) packed with zirconia beads having an average diameter of 0.5 mm, subjected to dispersion for 3 hours and 30 minutes, and then adjusted so as to have the reducing agent concentration of 25 wt % by adding 0.2 g of sodium salt of benzisothiazolinone and water. Thus, a dispersion of Reducing Agent-2 was obtained.

The reducing agent particles present in the thus-prepared dispersion had a median diameter of 0.40 μm and the maximum diameter of 1.5 μm or below. The dispersion of reducing agent was passed through a polypropylene filter having a pore size of 3.0 μm to eliminate extraneous materials including dusts, and then stored.

<Preparation of Dispersion of Hydrogen Bond-Forming Compound-1>

To a mixture of 10 kg of Hydrogen Bond-Forming Compound-1 (tri(4-tert-butylphenyl)phosphine oxide) and 16 kg of a 10 wt % aqueous solution of modified polyvinyl alcohol (Poval MP 203 produced by Kuraray Co., Ltd.) was added 10 kg of water, and the mixture was thoroughly admixed, thereby preparing a slurry.

The slurry was fed by means of a diaphragm pump into a horizontal sand mill (Model UVM-2 produced by AIMEX Co., Ltd.) packed with zirconia beads having an average diameter of 0.5 mm, subjected to dispersion for 3 hours and 30 minutes, and then adjusted so as to have the hydrogen bond-forming compound concentration of 25 wt % by adding 0.2 g of sodium salt of benzisothiazolinone and water. Thus, a dispersion of Hydrogen Bond-Forming Compound-1 was obtained.

The hydrogen bond-forming compound particles present in the thus-prepared dispersion had a median diameter of 0.35 μm and the maximum diameter of 1.5 μm or below. The dispersion of hydrogen bond-forming compound was passed through a polypropylene filter having a pore size of 3.0 μm to eliminate extraneous materials including dusts, and then stored.

<Preparation of Dispersion of Development Accelerator-1>

To a mixture of 10 kg of Development Accelerator-1 and 20 kg of a 10 wt % aqueous solution of modified polyvinyl alcohol (Poval MP 203 produced by Kuraray Co., Ltd.) was added 10 kg of water, and the mixture was thoroughly admixed, thereby preparing a slurry.

The slurry was fed by means of a diaphragm pump into a horizontal sand mill (Model UVM-2 produced by AIMEX Co., Ltd.) packed with zirconia beads having an average diameter of 0.5 mm, subjected to dispersion for 3 hours and 30 minutes, and then adjusted so as to have the development accelerator concentration of 20 wt % by adding 0.2 g of sodium salt of benzisothiazolinone and water. Thus, a dispersion of Development Accelerator-1 was obtained.

The development accelerator particles present in the thus-prepared dispersion had a median diameter of 0.48 μm and the maximum diameter of 1.4 μm or below. The dispersion was passed through a polypropylene filter having a pore size of 3.0 μm to eliminate extraneous materials including dusts, and then stored.

Each of Development Accelerator-2, Development Accelerator-3 and Color Tone Controlling Agent-1 was dispersed in the same manner as in Development Accelerator-1 to prepare a dispersion having a concentration of 20 wt %.

(Preparation of Dispersion of Polyhalogen Compound)

<Preparation of Dispersion of Organic Polyhalogen Compound-1>

To a mixture of 10 kg of Organic Polyhalogen Compound-1 (tribromomethanesulfonybenzene), 10 kg of a 20 wt % aqueous solution of modified polyvinyl alcohol (Poval MP 203 produced by Kuraray Co., Ltd.) and 0.4 kg of a 20 wt % aqueous solution of sodium triisopropylnaphthalenesulfonate was added 14 kg of water, and the mixture was thoroughly admixed, thereby preparing a slurry.

The slurry was fed by means of a diaphragm pump into a horizontal sand mill (Model UVM-2, made by AIMEX Co., Ltd.) packed with zirconia beads having an average diameter of 0.5 mm, subjected to dispersion for 5 hours, and then adjusted so as to have the organic polyhalogen compound concentration of 26 wt % by adding 0.2 g of sodium salt of benzisothiazolinone and water. Thus, a dispersion of Organic Polyhalogen Compound-1 was obtained.

The organic polyhalogen compound particles present in the thus-prepared dispersion had a median diameter of 0.41 μm and the maximum diameter of 2.0 μm or below. The dispersion of the organic polyhalogen compound was passed through a polypropylene filter having a pore size of 10.0 μm to eliminate extraneous materials including dusts, and then stored.

<Preparation of Dispersion of Organic Polyhalogen Compound-2>

A mixture of 10 kg of Organic Polyhalogen Compound-2 (N-butyl-3-tribromomethanesulfonylbenzamide), 20 kg of a 10 wt % aqueous solution of modified polyvinyl alcohol (Poval MP 203 produced by Kuraray Co., Ltd.) and 0.4 kg of a 20 wt % aqueous solution of sodium triisopropylnaphthalenesulfonate was thoroughly mixed to prepare a slurry.

The slurry was fed by means of a diaphragm pump into a horizontal sand mill (Model UVM-2, made by AIMEX Co., Ltd.) packed with zirconia beads having an average diameter of 0.5 mm, subjected to dispersion for 5 hours, and then adjusted so as to have the organic polyhalogen compound concentration of 30 wt % by adding 0.2 g of sodium salt of benzisothiazolinone and water. The dispersion was heated at 40° C. for 5 hours. Thus, a dispersion of Organic Polyhalogen Compound-2 was obtained.

The organic polyhalogen compound particles present in the thus-prepared dispersion had a median diameter of 0.40 μm and the maximum diameter of 1.3 μm or below. The dispersion of the organic polyhalogen compound was passed through a polypropylene filter having a pore size of 3.0 μm to eliminate extraneous materials including dusts, and then stored.

(Preparation of Solution of Phthalazine Compound-1)

In 174.57 kg of water, 8 kg of modified polyvinyl alcohol (Poval MP 203 produced by Kuraray Co., Ltd.) was dissolved. Thereto were added 3.15 kg of a 20 wt % aqueous solution of sodium triisopropylnaphthalenesulfonate and 14.28 kg of a 70 wt % aqueous solution of Phthalazine Compound-1 (6-isopropylphthalazine) to prepare a 5 wt % solution of Phtahalzine Compound-1.

(Preparation of Aqueous Solution of Mercapto Compound-2)

In 980 g of water was dissolved 20 g of Mercapto Compound-2 (sodium salt of 1-(3-methylureidophenyl)-5-mercaptotetrazole) to prepare a 2.0 wt % aqueous solution of Mercapto Compound-2.

(Preparation of SBR Latex)

A latex of SBR having Tg of 22° C. was prepared in the following manner.

A mixture of 70.0 parts by weight of styrene, 27.0 parts by weight of butadiene and 3.0 parts by weight of acrylic acid was subjected to emulsion polymerization using ammonium persulfate as a polymerization initiator and an anionic surfactant as an emulsifier, followed by aging at 80° C. for 8 hours. The polymerization product was then cooled to 40° C. and adjusted the pH to 7.0 with aqueous ammonia, and Sandet BL (produced by Sanyo Chemical Industries, Ltd.) was added thereto in an amount so as to make the content 0.22%. The pH of the resultant mixture was adjusted to 8.3 using a 5% aqueous solution of sodium hydroxide and then to 8.4 using aqueous ammonia.

The ratio of sodium ion to ammonium ion used in the pH adjustment was 1:2.3 by mole. Then, 0.15 ml of a 7% aqueous solution of sodium salt of benzisothiazolinone was added per kg of the mixture, thereby preparing a SBR latex.

SBR latex: Latex of -St(70.0)-Bu(27.0)-AA(3.0)-

Tg=22° C.; Average particle size: 0.1 μm; Concentration: 43 wt %; Equilibrium moisture content at 25° C. and 60% RH: 0.6 wt %; Ionic conductivity of undiluted latex (43 wt %): 4.2 mS/cm (measured at 25° C. with a conductometer (Model CM-30S produced by DKK-TOA Corp.); pH: 8.4

SBR latices having different Tg values can be prepared in a similar manner described above by appropriately varying the ratio of styrene and butadiene.

(Preparation of Coating Solution-1 for Emulsion Layer (Photosensitive Layer))

To 1,000 g of Fatty Acid Silver Salt Dispersion 1 were added successively 276 ml of water, 9.6 g of the dispersion of Organic Polyhalogen Compound-1, 26.1 g of the dispersion of Organic Polyhalogen Compound-2, 173 g of the solution of Phthalazine Compound-1, 1,082 g of the SBR latex (Tg: 22° C.), 155 g of the dispersion of Reducing Agent-2, 55 g of the dispersion of Hydrogen Bond-Forming Compound-1, 1 g of the dispersion of Development Accelerator-1, 2 g of the dispersion of Development Accelerator-2, 3 g of the dispersion of Development Accelerator-3, 2 g of the dispersion of Color Tone Controlling Agent-1 and 6 ml of the solution of Mercapto Compound-2. Thereto, 117 g of Silver Halide Mixed Emulsion A was added just before coating, followed by mixing thoroughly. The resulting coating solution for emulsion layer was fed into a coating die without delay and subjected to coating operation. The coating solution has the compositions shown in Experiment 1 of Table 1 below.

The viscosity of the coating solution was 40 [mPa·s], measured at 40° C. (No.1 rotor, 60 rpm) with a Brookfield type viscometer produced by Tokyo Keiki Kogyo.

Further, the coating solution had viscosity values of 530, 144, 96, 51 and 28 [mPa·s] measured at 25° C. under shear rates of 0.1, 1, 10, 100 and 1,000 [1/sec], respectively, by means of RFS Fluid Spectrometer produced by Rheometrics Fareast Co., Ltd.

The content of zirconium in the coating solution was 0.25 mg per g of silver.

(Preparation of Coating Solutions-2 to -5 for Emulsion Layer (Photosensitive Layer))

Coating Solutions-2 to -5 for Emulsion Layer (Photosensitive Layer) were prepared in the same manner as in Preparation of Coating Solution-1 for Emulsion Layer (Photosensitive Layer) except for changing the fatty acid silver salt dispersion and the silver halide emulsion to those shown in Table 2 below, respectively.

(Preparation of Coating Solution for Interlayer on Emulsion Side)

A coating solution for interlayer was prepared by mixing 1,000 g of polyvinyl alcohol (PVA-205 produced by Kuraray Co., Ltd.), 272 g of a 5 wt % pigment dispersion, 4,200 ml of a 19 wt % latex of methyl methacrylate/styrene/butyl acrylate/hydroxyethyl methacrylate/acrylic acid copolymer (copolymerization ratio: 64/9/20/5/2 by weight), 27 ml of a 5 wt % aqueous solution of Aerosol OT (produced by American Cyanamid Co.) and 135 ml of a 20 wt % aqueous solution of diammonium phthalate, adding thereto water in an amount to make the total amount 10,000 g, and adjusting the pH to 7.5 by adding NaOH. The coating solution was fed into a coating die to attain a coverage of 9.1 ml/$m^2$.

The viscosity of the coating solution was 58 [mPa·s] at 40° C. (No.1 rotor, 60 rpm) as measured with the Brookfield type viscometer.

(Preparation of Coating Solution for Protective Layer on Emulsion Side)

<Preparation of Coating Solution for First Protective Layer on Emulsion Side>

In water was dissolved 64 g of inert gelatin, and thereto were added 80 g of the 27.5 wt % latex of methyl methacrylate/styrene/butyl acrylate/hydroxyethyl methacrylate/acrylic acid copolymer (copolymerization ratio: 64/9/20/5/2 by weight), 23 ml of a 10 wt % methanol solution of phthalic acid, 23 ml of a 10 wt % aqueous solution of 4-methylphthalic acid, 28 ml of diluted sulfuric acid having a concentration of 0.5 mole/L, 5 ml of a 5 wt % water solution of Aerosol OT (American Cyanamid Co.), 0.5 g of phenoxyethanol and 0.1 g of benzoisothiazolinone. Further, water was added thereto in the amount to adjust the total weight of the resultant mixture to 750 g, thereby preparing a coating solution. The coating solution was mixed with 26 ml of a 4 wt % aqueous solution of chrome alum by means of a static mixer just before coating, and fed into a coating die to attain a coverage of 18.6 ml/m$^2$.

The viscosity of the coating soluton was 20 [mPa·s] at 40° C. (No.1 rotor, 60 rpm) as measured with the Brookfield type viscometer.

<Preparation of Coating Solution for Second Protective Layer on Emulsion Side>

In water was dissolved 80 g of inert gelatin, and thereto were added 102 g of a 27.5 wt % latex of methyl methacrylate/styrene/butyl acrylate/hydroxyethyl methacrylate/acrylic acid copolymer (copolymerization ratio: 64/9/20/5/2 by weight), 3.2 ml of a 5 wt % aqueous solution of fluorine-containing surfactant (F-1), 32 ml of a 2 wt % water solution of fluorine-containing surfactant (F-2), 3 ml of a 5 wt % solution of fluorine-containing surfactant F-5, 10 ml of a 2% solution of fluorine-containing surfactant F-6, 23 ml of a 5 wt % solution of Aerosol OT (American Cyanamid Co.), 4 g of fine particle of polymethylmethacrylate (average particle size: 0.7 μm), 21 g of fine particle of polymethyl methacrylate (average particle size: 4.5 μm), 1.6 g of 4-methylphthalic acid, 4.8 g of phthalic acid, 44 ml of diluted sulfuric acid having a concentration of 0.5 mole/L and 10 mg of benzoisothiazolinone. Further, water was added thereto in the amount to adjust the total weight to 650 g and, just before coating, and mixed with 445 ml of aqueous solution containing 4 wt % chrome alum and 0.67 wt % of phthalic acid by means of a static mixer, thereby preparing a coating solution for second protective layer on the emulsion side. The solution was fed into a coating die to attain a coverage of 8.3 ml/m$^2$.

The viscosity of the coating solution was 19 [mPa·s] at 40° C. (No.1 rotor, 60 rpm) as measured with the Brookfield type viscometer.

(Production of Heat-Developable Photosensitive Material 1)

On the back side of the support provided with the undercoat layers, the coating solution for antihalation layer and the coating solution for back protective layer were coated so as to have an absorption of 0.3 at 405 nm and a gelatin coverage of 1.7 g/m$^2$, respectively, using a simultaneous double coating method, and then dried to prepare a backing layer.

On the undercoat side opposite to the backside of the support, Coating Solution-1 for Emulsion Layer, Coating Solution for Interlayer, Coating Solution for First Protective Layer and Coating Solution for Second Protective Layer were coated simultaneously in this order using a slide bead coating method, thereby producing a heat-developable photosensitive material. The temperatures of Coating Solution-1 for Emulsion Layer and Coating Solution for Interlayer were adjusted to 31° C., that of Coating Solution for First Protective Layer was adjusted to 36° C., and that of Coating Solution for Second Protective Layer was adjusted to 37° C.

The coverage (g/m$^2$) of each ingredient in the emulsion layer was described below:

| | |
|---|---|
| Silver behenate | 5.55 |
| Polyhalogen Compound-1 | 0.06 |
| Polyhalogen Compound-2 | 0.18 |
| Phthalazine Compound-1 | 0.19 |
| SBR latex | 9.67 |
| Reducing Agent-2 | 0.81 |
| Hydrogen Bond-Forming Compound-1 | 0.30 |
| Development Accelerator-1 | 0.004 |
| Development Accelerator-2 | 0.010 |
| Development Accelerator-3 | 0.015 |
| Color Tone Controlling Agent-1 | 0.010 |
| Mercapto Compound-2 | 0.002 |

Silver Halide Amount as Shown in Table 2

The coating and drying conditions adopted were as follows:

The coating operation was carried out at a speed of 160 m/min, the clearance between the tip of the coating die and the support was chosen from the range of 0.10 to 0.30 mm, and the pressure of the vacuum chamber was controlled so as to be from 196 to 882 Pa lower than atmospheric pressure. Prior to coating, static charge of the support was eliminated by ion wind.

In the chilling zone subsequent to the coating zone, the air having a dry-bulb temperature of 10 to 20° C. was made to blow against the coated layers to effect the chilling. Thereafter, the support with the coated layers was conveyed in a contact-free condition, and dried by blowing drying air having a dry-bulb temperature of 23 to 45° C. and a wet-bulb temperature of 15 to 21° C. using a helical non-contact dryer.

After the drying, the coated layers underwent moisture adjustment at 25° C. under humidity of 40 to 60% RH, and then heated up to 70 to 90° C., followed by cooling to 25° C.

The matting degree of the heat-developable photosensitive material thus produced was 550 seconds on the surface of photosensitive layer side and 130 seconds on the surface of back layer side in terms of Bekk smoothness. The pH on the surface of photosensitive layer side was found to be 6.0.

(Production of Heat-Developable Photosensitive Materials 2 to 5)

Heat-Developable Photosensitive Materials 2 to 5 were produced in the same manner as in Production of Heat-Developable Photosensitive Material 1 except for using Coating Solutions-2 to -5 for Emulsion Layer in place of Coating Solution-1 for Emulsion Layer, respectively.

The chemical structures of the compounds used in the example are illustrated below:

Tellurium Sensitizer C

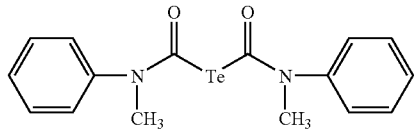

Blue Dye Compound-1
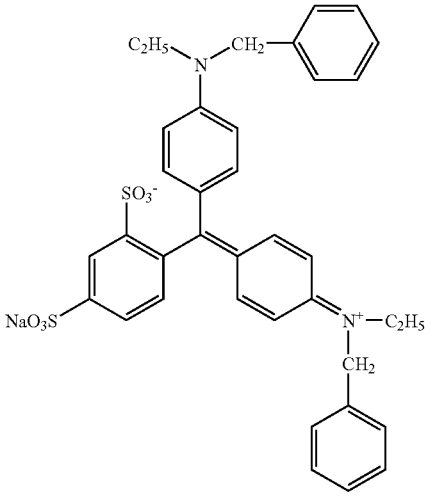
Yellow Dye Compound-1
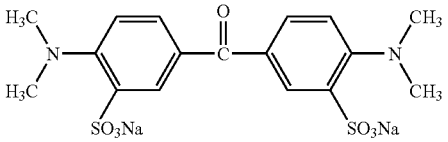
Reducing Agent-2
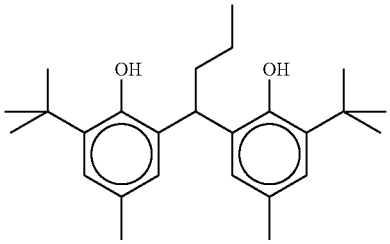
Hydrogen Bond-Forming Compound-1
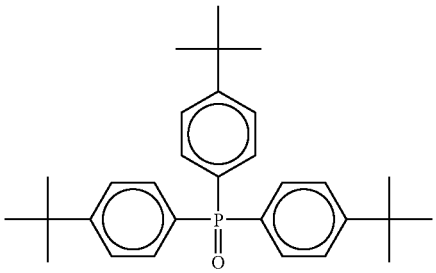
Polyhalogen Compound-1
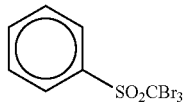
Polyhalogen Compound-2
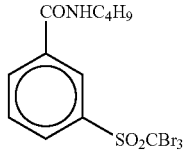
Mercapto Compound-1
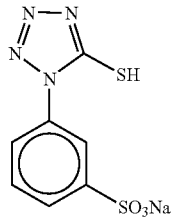
Mercapto Compound-2
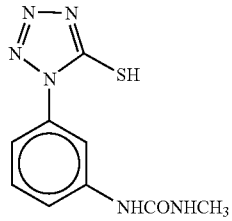
Phthalazine Compound-1
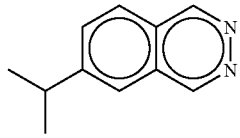
Development Accelerator-1
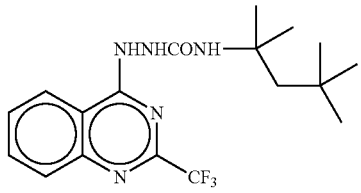
Development Accelerator-2
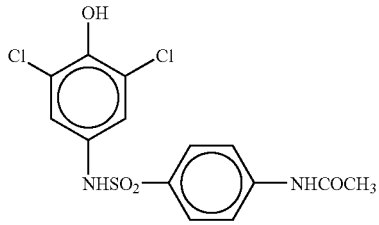

-continued

Development Accelerator-3

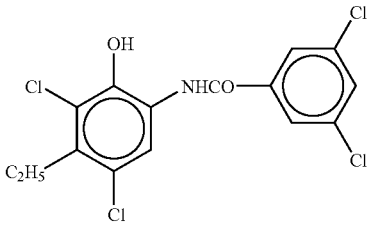

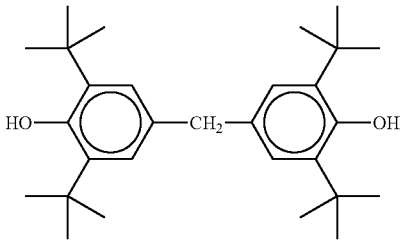

Color Tone Controlling Agent-1

F-1

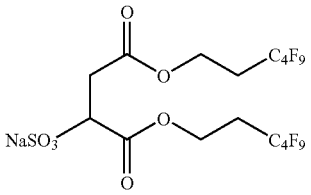

F-2

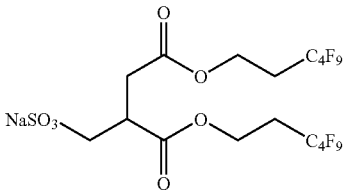

F-3

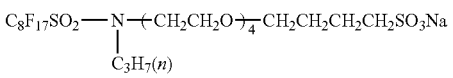

F-4 $C_8F_{17}S_3K$

F-5 $CF_3(CF_2)_nCH_2CH_2SCH_2CH_2COOLi$
mixture of the compounds with n=5 to 11

F-6 $CF_3(CF_2)_nCH_2CH_2O(CH_2CH_2O)_mH$
mixture of the compounds with n=5 to 11 and m=5 to 15

F-7 $CF_3(CF_2)_nCH_2CH_2SO_3Na$
mixture of the compounds with n=5 to 11

F-8 $C_6F_{13}CH_2CH_2SO_3Li$ (Preparation for Evaluation of Photographic Properties)

The photosensitive material obtained was cut into sheets of 17×14-inch size (43 cm×35.4 cm), packaged with the following packaging material in an environment of 25° C. and 50% RH, and stored for 2 weeks at room temperature.

(Packaging Material)

A composite sheet of 10 μm-thick PET/12 μm-thick PE/9 μm-thick aluminum foil/15 μm-thick Ny/50 μm-thick polyethylene containing 3% carbon black having oxygen-permeability of $2.28\times10^{-8}$ ml/Pa·m$^2$·S (25° C.) (0.02 ml/atm·m$^2$·25° C.·day) and moisture-permeability of $1.14\times10^{-7}$ g/Pa·m$^2$·s (25° C.) (0.10 g/atm·m$^2$·25° C.·day) was used.

<Exposure of Heat-Developable Photosensitive Material>

Each of Heat-Developable Photosensitive Materials 1 to 5 was subjected to exposure in the following manner.

In an exposure section of Fuji Medical Dry Laser Imager FM-DPL, a laser diode, NLHV3000E, produced by NICHIA CORPORATION was mounted as a laser diode light source, and the beam was converged to form a diameter of about 100 μm. Each photosensitive material was exposed to the laser light at the surface illuminance of 0 and those varied between 1 mW/mm$^2$ and 1,000 mW/mm$^2$ for $10^{-6}$ second. The wavelength of light emitted from the laser diode was 405 nm.

<Development of Heat-Developable Photosensitive Material>

The exposed heat-developable photosensitive materials were each subjected to heat-development processing in the following manner.

In a heat-development section of Fuji Medical Dry Laser Imager FM-DPL, heat-development was performed under conditions that 4 built-in panel heaters were set at 120° C., 120° C., 120° C. and 120° C., respectively, and the total heat-development time was adjusted to 20 seconds by controlling the speed of film conveyance.

<Evaluation of Initial Sensitivity>

The density of the image obtained was measured with a densitometer, and a characteristic curve was prepared by plotting the density as ordinate and a logarithm of the exposure amount as abscissa. The optical density of unexposed area was defined as fog. A reciprocal of the exposure amount necessary for providing the optical density of 1.0 was defined as sensitivity, and the sensitivity is relatively indicated taking the sensitivity of Heat-Developable Photosensitive Material 1 as 100. The results obtained are shown in Table 2 below.

(Evaluation of Re-Exposure Sensitivity After Heat-Development)

Each of Heat-Developable Photosensitive Materials 1 to 5 was subjected the heat-development in the same manner as above without exposure. Then, the heat-developable photosensitive material was exposed, heat-developed and evaluated the sensitivity in the same manner as in the evaluation of initial sensitivity. The results obtained are shown in Table 2 below.

TABLE 2

| Experiment No. | Photo-Sensitive Material | Silver Halide Emulsion No. | Iodide Content | Bromide Content | Size of Silver Halide Grain | Mole % of Silver Halide per Mole of Fatty Acid Silver Salt | Fatty Acid Silver Salt No. | Specific Surface Area |
|---|---|---|---|---|---|---|---|---|
| 1 | 1 | 1 | 100 | 0 | 40 nm | 7 | 1 | 25 |
| 2 | 2 | 1 | 100 | 0 | 40 nm | 7 | 2 | 21 |
| 3 | 3 | 1 | 100 | 0 | 40 nm | 7 | 3 | 16 |
| 4 | 4 | 1 | 100 | 0 | 40 nm | 7 | 4 | 7 |
| 5 | 5 | 2 | 0 | 100 | 40 nm | 7 | 4 | 7 |

| Experiment No. | Condition of Heat-Development | Initial Sensitivity | Re-Exposure Sensitivity after Heat-Development | Sensitivity Ratio (after Heat-Development /Initial) | Remarks |
|---|---|---|---|---|---|
| 1 | 120° C./20 sec | 100 | 0 | 0.00 | Invention |
| 2 | 120° C./20 sec | 105 | 2 | 0.02 | Invention |
| 3 | 120° C./20 sec | 100 | 7 | 0.07 | Invention |
| 4 | 120° C./20 sec | 95 | 25 | 0.26 | Comparison |
| 5 | 120° C./20 sec | 160 | 110 | 0.69 | Comparison |

It is apparent from the results shown in Table 2 that Heat-Developable Photosensitive Materials 1 to 3 of the invention exhibit a remarkably small sensitivity ratio between before and after heat-development as compared with Heat-Developable Photosensitive Materials 4 and 5 for comparison. Using the heat-developable photosensitive material of the invention, light shielding of the photosensitive material after heat-development in a cooling zone is made redundant and a heat-developing machine can be miniaturized. Also, the photosensitive material of the invention is excellent in preservation stability after heat-development processing.

It can also be seen from the results shown in Table 2 that a large specific surface area of the fatty acid silver salt is important in order to obtain the preferred effects of the invention. Further, silver iodide is advantageous because of the large reduction in sensitivity compared with silver bromide.

EXAMPLE 2

Using Heat-Developable Photosensitive Material 2, the comparison of initial sensitivity with re-exposure sensitivity after heat-development was conducted in the same manner as in Example 1 except for changing the temperature and time for heat-development as shown in Table 3 below. The results obtained are shown in Table 3 below.

TABLE 3

| Experiment No. | Photo-Sensitive Material | Silver Halide Emulsion No. | Iodide Content | Bromide Content | Size of Silver Halide Grain | Mole % of Silver Halide per Mole of Fatty Acid Silver Salt | Fatty Acid Silver Salt No. | Specific Surface Area |
|---|---|---|---|---|---|---|---|---|
| 6 | 2 | 1 | 100 | 0 | 40 nm | 7 | 2 | 21 |
| 7 | 2 | 1 | 100 | 0 | 40 nm | 7 | 2 | 21 |
| 8 | 2 | 1 | 100 | 0 | 40 nm | 7 | 2 | 21 |
| 9 | 2 | 1 | 100 | 0 | 40 nm | 7 | 2 | 21 |

| Experiment No. | Condition of Heat-Development | Initial Sensitivity | Re-Exposure Sensitivity after Heat-Development | Sensitivity Ratio (after Heat-Development /Initial) | Remarks |
|---|---|---|---|---|---|
| 6 | 130° C./10 sec | 130 | 0 | 0.00 | Invention |
| 7 | 120° C./10 sec | 80 | 3 | 0.04 | Invention |
| 8 | 110° C./10 sec | 60 | 5 | 0.08 | Invention |
| 9 | 105° C./10 sec | 35 | 20 | 0.57 | Invention |

It can be seen that the sensitivity ratio between before and after heat-development varies depending on the conditions of heat-development. By the development at temperature of 110° C. or above, disappearance of silver halide due to the heat-development occurs and the effects of the invention are preferably achieved.

EXAMPLE 3

The Fuji Medical Dry Laser Imager FM-DPL used in Example 1 was converted so that a heat-developable photosensitive material can be directly discharged from the heat-development zone of the apparatus to the outside exposed to light without passing through the cooling zone.

Using the converted apparatus, Heat-Developable Photosensitive Materials 2 and 5 were subjected to heat-development without exposure to light. Fog occurred on Heat-Developable Photosensitive Material 5 in which sensitivity still remained. On the contrary, the occurrence of fog was preferably not observed in Heat-Developable Photosensitive Material 2.

By using the heat-developable photosensitive material, which loses the sensitivity by the heat-treatment, heat-developing machine can be simplified.

EXAMPLE 4

(Preparation of Silver Halide Emulsions 3 to 5)

Silver Halide Emulsions 3 to 5 having different sizes of silver halide grain as shown in Table 4 shown below were prepared in the same manner as in Preparation of Silver Halide Emulsion 1 except that the temperature for silver halide grain formation was changed from 42° C. to 30° C., 50° C. and 75° C., respectively.

(Production of Heat-Developable Photosensitive Materials 6 to 9)

Heat-Developable Photosensitive Materials 6 to 9 were produced in the same manner as in Heat-Developable Photosensitive Material 2 except for changing Silver Halide Emulsion 1 to each of Silver Halide Emulsions 3 to 5 and using 3.5 mole % of silver halide per mole of fatty acid silver salt.

The photosensitive materials were subjected to the exposure to light and heat-development in the same manner as in Experiment No. 7 of Example 2. The results obtained are shown in Table 4 below.

TABLE 4

| | | Silver Halide Emulsion | | | | | Fatty Acid Silver Salt | |
|---|---|---|---|---|---|---|---|---|
| Experiment No. | Photo-Sensitive Material | No. | Iodide Content | Bromide Content | Size of Silver Halide Grain | Mole % of Silver Halide per Mole of Fatty Acid Silver Salt | No. | Specific Surface Area |
| 10 | 6 | 3 | 100 | 0 | 23 nm | 3.5 | 2 | 21 |
| 11 | 7 | 1 | 100 | 0 | 40 nm | 3.5 | 2 | 21 |
| 12 | 8 | 4 | 100 | 0 | 55 nm | 3.5 | 2 | 21 |
| 13 | 9 | 5 | 100 | 0 | 100 nm | 3.5 | 2 | 21 |

| Experiment No. | Condition of Heat-Development | Initial Sensitivity | Re-Exposure Sensitivity after Heat-Development | Sensitivity Ratio (after Heat-Development /Initial) | Remarks |
|---|---|---|---|---|---|
| 10 | 120° C./10 sec | 120 | 0 | 0.00 | Invention |
| 11 | 120° C./10 sec | 150 | 0 | 0.00 | Invention |
| 12 | 120° C./10 sec | 160 | 15 | 0.09 | Invention |
| 13 | 120° C./10 sec | 100 | 18 | 0.18 | Invention |

It can be seen that as the size of silver halide grain is small, the effects of the invention are more preferably achieved. The reason for this is presumably that smaller silver halide grains are more easily dissolved.

EXAMPLE 5

Heat-Developable Photosensitive Materials 10 and 11 were prepared in the same manner as in Heat-Developable Photosensitive Materials 1 and 5 except for increasing twice the amounts of development accelerators, respectively. Each heat-developable photosensitive material was cut into sheets of 17×14-inch size (43 cm×35.4 cm), B4 size (25.7 cm×36.5 cm) and 8×10-inch size (20.1 cm×25.3 cm) and the sheets were subjected to corner cut. One hundred and one sheets of the 17×14-inch heat-developable photosensitive materials, 151 sheets of the B4 heat-developable photosensitive materials and 151 sheets of the 8×10-inch heat-developable photosensitive materials were supplied in upper, middle and lower trays of a heat-developing machine having a structure shown in FIG. 4, respectively. The heat-developing machine was equipped with a laser diode NLHV3000E produced by NICHIA CORPORATION. A test pattern image was outputted on each 50 sheets of the 17×14-inch, B4 and 8×10-inch heat-developable photosensitive materials one after the other in this order and the total of 150 sheets were processed. The ratio of zone length of the cooling section to zone length of the heat-development section was 1.5 in the heat-developing machine.

Plate heaters 64*a*, 64*b* and 64*c* were adjusted at 107° C., 121° C. and 121° C., respectively. The heat-development processing was conducted under conditions of a line speed of 39 mm/sec and a developing time of 10 seconds. Lighting on a discharging section for heat-developable photosensitive material was controlled to light intensity of 1,000 lux with a fluorescent lump.

After the continuous processing of 150 sheets of the heat-developable photosensitive materials, the sheets were allowed to stand on the discharging section under the light-intensity of 1,000 lux with a fluorescent lump for one hour or two hours. Thereafter, the sheets of the heat-developable photosensitive materials were observed on Schaukasten (light box) and evaluated whether the image of upper sheet was formed on the lower sheet upon the illumination of florescent lump or not.

Evaluation Criteria:

A: Image of upper sheet is not formed on the lower sheet at all.

B: Image of upper sheet was slightly formed on the lower sheet, but there aren't any problems with practical use.

C: Image of upper sheet was clearly formed on the lower sheet and there is a problem of affecting the diagnosis.

Ultraviolet-Blue Light Absorbing Compound-2

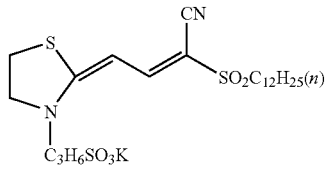

With respect to preferred anti-halation compositions, the descriptions in Japanese Patent Application No. 2001-346956 can be referred to. Further, the compounds represented by formulae (1) to (6) described in the above patent application are preferably used. In the invention, Compounds 1 to 89 described in the above patent application are particularly preferred.

In accordance with the invention, the heat-developable photosensitive material that has high sensitivity, no occurrence of fog due to light after heat-development and excellent handlability after development and is applicable to a simple and small-size heat-developing machine can be provided.

TABLE 5

| Experiment No. | Photo-Sensitive Material | Silver Halide Emulsion No. | Iodide Content | Bromide Content | Size of Silver Halide Grain | Condition of Heat-Development | Initial Sensitivity | Re-Exposure Sensitivity after Heat-Development | Sensitivity Ratio (after Heat-Development /Initial) | Image formed after One Hour | Image formed after Two Hours | Remarks |
|---|---|---|---|---|---|---|---|---|---|---|---|---|
| 14 | 10 | 1 | 100 | 0 | 40 nm | 120° C./10 sec | 120 | 0 | 0.00 | A | A | Invention |
| 15 | 11 | 2 | 0 | 100 | 40 nm | 120° C./10 sec | 155 | 95 | 0.61 | B | C | Comparison |

It can bee seen from the results shown in Table 5 that in the developing machine having a small ratio of the zone length of the cooling section to the zone length of the heat-development section, when a large amount of heat-developable photosensitive materials are continuously processed in a short period of time, capacity of the cooling section is insufficient for cooling the heat-developable photosensitive materials and thus the heat-developable photosensitive materials are discharged on the discharging section while they are still warm. In such circumstances, the heat-developable photosensitive materials for comparison suffer damages from print-out and the reaction subsequent to the development upon exposure to light such as room light. On the contrary, such problems are preferably resolved with the heat-developable photosensitive materials according to the invention.

EXAMPLE 6

Heat-developable photosensitive materials were produced in the same manner as in Heat-Developable Photosensitive Materials 1 to 11 except for using Ultraviolet-Blue Light Absorbing Compound-2 shown below in place of Yellow Dye Compound-1 in an amount so as to have the equivalent absorbance of laser beam, and subjected to the same experiments as in Examples 1 to 5. Preferred results were obtained, similarly.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A method of forming an image, which comprises: image-wise exposing a mono-sheet heat developable photosensitive material to laser diode light source having light intensity of not less than 1 mW/mm$^2$ at a wavelength of 350 nm to 430 nm, and heat-developing the exposed material at a temperature of from 110 to 150° C. by a heat-developing machine having an exposure section, a heat-development section and a cooling section, wherein a ratio of a zone length of the cooling section to a zone length of the heat-development section is not more than 3.5, wherein the mono-sheet heat developable photosensitive material comprises a support having a layer thereon containing:

(a) a light-insensitive organic fatty acid silver salt including at least silver behenate having a specific surface area of not less than 10;

(b) a light-sensitive silver halide that is prepared in the absence of the light-insensitive organic fatty acid silver salt and has an average silver iodide content of from 70 to 100 mole %;

(c) a thermal developer;

(d) an organic polyhalogen compound that is represented by the following formula (H):

$$Q—(Y)_n—C(Z_1)(Z_2)X \quad (H)$$

wherein Q represents an alkyl group, an aryl group or a heterocyclic group; Y represents a divalent connecting group; n represents 0 or 1; $Z_1$ and $Z_2$ each represents a halogen atom; and X represents a hydrogen atom or an electron withdrawing group;

(e) a phthalazine compound; and (f) a binder, and wherein the photosensitive material exhibits substantially no light-sensitivity after being subjected to heat-development.

2. The method as claimed in claim 1, wherein the light-insensitive organic fatty acid silver salt including silver behenate a specific surface area of not less than 15.

* * * * *